US008672356B2

(12) United States Patent
Inaguma et al.

(10) Patent No.: US 8,672,356 B2
(45) Date of Patent: Mar. 18, 2014

(54) SEATBELT DEVICE FOR WHEELCHAIR

(75) Inventors: Yukio Inaguma, Kariya (JP); Kenji Horiguchi, Kariya (JP); Akira Ishii, Kariya (JP); Fumiaki Katou, Kariya (JP); Masaaki Yamane, Kariya (JP)

(73) Assignee: Toyota Shatai Kabushiki Kaisha, Aichi-Ken (JP)

( * ) Notice: Subject to any disclaimer, the term of this patent is extended or adjusted under 35 U.S.C. 154(b) by 85 days.

(21) Appl. No.: 13/390,879

(22) PCT Filed: Jul. 22, 2010

(86) PCT No.: PCT/JP2010/062330

§ 371 (c)(1),
(2), (4) Date: Apr. 27, 2012

(87) PCT Pub. No.: WO2011/021471

PCT Pub. Date: Feb. 24, 2011

(65) Prior Publication Data

US 2012/0219395 A1 Aug. 30, 2012

(30) Foreign Application Priority Data

Aug. 18, 2009 (JP) ..... 2009-189161
Feb. 22, 2010 (JP) ..... 2010-035852
Feb. 24, 2010 (JP) ..... 2010-038153

(51) Int. Cl.
*B60P 3/00* (2006.01)
*B60R 22/00* (2006.01)

(52) U.S. Cl.
USPC ..... 280/801.1; 280/250.1; 297/468; 414/253

(58) Field of Classification Search
USPC ..... 280/250.1, 801.1, 808; 297/468, 483, 297/485; 414/233–235, 241–244, 253, 257, 414/261, 373, 390, 391, 399, 401, 402, 539, 414/540, 545, 556
See application file for complete search history.

(56) References Cited

U.S. PATENT DOCUMENTS

2005/0214088 A1 * 9/2005 Acton ..... 410/3

FOREIGN PATENT DOCUMENTS

| | | | | |
|---|---|---|---|---|
| EP | 71959 A2 * | 2/1983 | ..... | B62D 47/02 |
| JP | 2001047969 A * | 2/2001 | ..... | B60R 22/12 |
| JP | 2002-166822 | 6/2002 | | |
| JP | 2002209946 A * | 7/2002 | ..... | A61G 3/00 |
| JP | 2004-229723 | 8/2004 | | |
| JP | 2004-299583 | 10/2004 | | |
| JP | 2005-304767 | 11/2005 | | |
| JP | 2006-103635 | 4/2006 | | |
| JP | 2007-167569 | 7/2007 | | |
| JP | 2008126991 A * | 6/2008 | | |
| JP | 2008149875 A * | 7/2008 | | |
| JP | 2010173355 A * | 8/2010 | | |

* cited by examiner

*Primary Examiner* — Nicole Verley
*Assistant Examiner* — Laura Freedman
(74) *Attorney, Agent, or Firm* — Christensen Fonder P.A.

(57) ABSTRACT

An engagement fixture of a shoulder belt is connected to and supported by an engagement buckle disposed in a vehicle interior. When a platform is positioned in a getting in/out position in a vehicle exterior, the engagement fixture of the shoulder belt can be temporarily connected to a temporary fastening fixture provided to the platform. To the contrary, when the platform is positioned in a loading position in a vehicle interior, a connection condition of the engagement fixture of the shoulder belt can be changed from a temporary connection of the fastening fixture to a securely supportable connection of an engagement buckle in the vehicle interior. Thus, it is possible to simplify a belt attaching operation after a wheelchair is loaded in a vehicle while a columnar support member used in the conventional platform is abolished.

12 Claims, 21 Drawing Sheets

SEATBELT DEVICE FOR WHEELCHAIR

PRIORITY CLAIM

The present application is a National Phase entry of PCT Application No. PCT/JP2010/062330, filed Jul. 22, 2010, which claims priority from Japanese Patent Application Number 2009-189161 filed Aug. 18, 2009, Japanese Patent Application Number 2010-035852, filed Feb. 22, 2010, and Japanese Patent Application Number 2010-038153, filed Feb. 24, 2010, the disclosures of which are hereby incorporated by reference herein in their entirety.

TECHNICAL FIELD

The present invention relates to a wheelchair seatbelt device that is provided to a wheelchair lifting and transferring device and that is configured to constrain the body of a wheelchair-sitting person sitting in a wheelchair that is loaded in a vehicle.

BACKGROUND ART

In recent years, there is an automobiles that is called a welfare vehicle in which a wheelchair-sitting person sitting in a wheelchair can be loaded with the wheelchair. Such a welfare vehicle has a wheelchair lifting and transferring device in order to load the wheelchair-sitting person therein with the wheelchair (Japanese Laid-Open Patent Application No. 2005-304767 described below). The wheelchair lifting and transferring device generally has a platform on which the wheelchair is to be placed, and a lifting and transferring mechanism that is configured to lift-transfer this platform from a vehicle exterior to a vehicle interior. The wheelchair lifting and transferring device is configured to lower the platform onto a road surface in the vehicle exterior. The wheelchair-sitting person is placed on the platform lowered onto the road surface with the wheelchair. The platform on which the wheelchair placed is transferred into the vehicle interior by the lifting and transferring mechanism, whereby the wheelchair-sitting person is loaded in the vehicle with the wheelchair.

Like an ordinary passenger, such a wheelchair-sitting person thus loaded in the vehicle is also required to be seatbelted. In this connection, the wheelchair lifting and transferring device disclosed in Japanese Laid-Open Patent Application No. 2005-304767 is provided with a seat-belt device having a wrap belt that is capable of constraining the waist of the wheelchair-sitting person and a shoulder belt that is capable constraining the upper half of his/her body from the shoulder to the waist.

According to this seatbelt device, it is possible to constrain the body of the wheelchair-sitting person by the wrap belt and the shoulder belt. Further, in order to apply the wrap belt and the shoulder belt to such a person, an application operation is performed with attention to the following points. That is, when the wrap belt and the shoulder belt is applied to the person, it is necessary to additionally thread the belts under an armrest of the wheelchair and between spokes of wheels of the wheelchair such that the belts may reliably contact the body of the wheelchair-sitting person. However, it is difficult for the wheelchair-sitting person to perform a threading operation of the belts. Therefore, such an operation may generally be performed by a person assisting loading of the wheelchair-sitting person (which may be hereinafter referred to as a loading assistant).

SUMMARY OF THE INVENTION

Problems to be Solved by the Invention

Regarding the shoulder belt for constraining the upper half of the body of the wheelchair-sitting person, it is advantageous that its shoulder side support end is position above the shoulder of the wheelchair-sitting person. Therefore, the platform disclosed in Patent Document 1 described above is provided with a columnar support member for supporting the shoulder side support end of the shoulder belt. However, when the columnar support member is provided to one side of the platform makes, it is difficult for the loading assistant to perform the threading operation of the belts. In addition, the platform itself can be poorly balanced. Thus, some people are interested in eliminating the columnar support member from the platform.

On the other hand, as described above, the application operation of the wrap belt and the shoulder belt must be performed with considering positions through which the belts are passed. Therefore, it is complicated to perform the belt application operation. Thus, it is preferable that the belt application operation can be easily performed after the wheelchair has been introduced into the narrow vehicle interior.

Thus, there is a need in the art to provide an improved wheelchair seatbelt device.

SUMMARY OF THE INVENTION

A first aspect of the present invention provides a wheelchair seatbelt device provided to a wheelchair lifting and transferring device having a platform on which a wheelchair is placed and a lifting and transferring mechanism that is configured to lift-transfer the platform from a getting in/out position in a vehicle exterior to a loading position in a vehicle interior, the device being configured to constrain the body of a wheelchair-sitting person sitting in the wheelchair in a placed condition in which the wheelchair is placed on the platform. The wheelchair seatbelt device includes a wrap belt portion capable of constraining the waist of the wheelchair-sitting person, and a shoulder belt portion having one end that constitutes a waist side support end corresponding to a waist side of the wheelchair-sitting person and the other end that constitutes a shoulder side support end corresponding to a shoulder side of the wheelchair-sitting person, and capable of being extended obliquely from the shoulder to the waist of the wheelchair-sitting person to constrain the upper half of the body of the wheelchair-sitting person. The waist side support end of the shoulder belt portion is supported by a platform side support portion disposed on the platform. The shoulder side support end of the shoulder belt portion is capable of being connected to both of a belt temporary fastening portion disposed on the platform and a final connection support portion disposed in the vehicle interior, and is capable of being temporarily connected to the belt temporary fastening portion when the platform is positioned in the getting in/out position and when the platform is lift-transferred. When the platform is positioned in the loading position, a connection condition of the shoulder side support end of the shoulder belt portion can be changed from a temporary connection in which it is temporarily connected to the belt temporary fastening portion to a securely supportable connection in which it is connected to the final connection support portion in the vehicle interior.

According to the wheelchair seat belt device of the first aspect of the present invention, the shoulder side support end of the shoulder belt portion is connected to and supported by the final connection support portion disposed in the vehicle interior. Therefore, the body of the sitting person sitting in the wheelchair loaded in a vehicle by the wheelchair lifting while a columnar support member used in the conventional platform is abolished. Due to the abolishment of the columnar support member, various advantages are obtained. For example, it is possible to achieve an improvement in balance of the platform and a reduction in weight and cost. Further, a wheelchair loading area on the platform can be increased. As a result, for example, a loading assistant can easily perform a threading operation of the belts. Further, it is possible to provide a satisfactory field of vision in a rear side of the vehicle and to enlarge an acceptable range regarding the kind of wheelchair to be loaded therein.

In addition, because the belt temporary fastening portion is attached to the platform, when the platform is positioned in the getting in/out position in the vehicle exterior before it is lift-transferred by the lifting and transferring mechanism, the shoulder side support end of the shoulder belt portion can be temporarily connected to this belt temporary fastening portion. To the contrary, when the platform is positioned in the loading position in the vehicle interior due to lift-transferring by the lifting and transferring mechanism, the connection condition of the shoulder side support end of the shoulder belt portion can be changed from the temporary connection to the belt temporary fastening portion to the securely supportable connection to the final connection support portion disposed in the vehicle interior. Therefore, it is possible to thread the shoulder belt portion under the armrest of the wheelchair and between the spokes of the wheel of the wheelchair such that the shoulder belt portion can reliably contact the body of the wheelchair-sitting person when the platform is positioned in the getting in/out position in the vehicle exterior, and it is possible to temporarily keep the shoulder side support end in this condition. Thereafter, when the platform is positioned in the loading position in the vehicle interior, it is only necessary to perform the simple operation of changing the connection condition of the shoulder side support end from the temporary connection to the belt temporary fastening portion to the securely supportable connection to the final connection support portion disposed in the vehicle interior.

A second aspect of the present invention provides the wheelchair seat belt device, in which the shoulder belt portion has an engagement fixture that is engageable with a buckle, and in which each of the belt temporary fastening portion of the platform and the final connection support portion positioned in the vehicle interior is formed by the buckle formed as a common component to which the engagement fixture is connected.

According to the wheelchair seatbelt device of the second aspect of the present invention, each of the belt temporary fastening portion and the final connection support portion is formed by the buckle formed as a common component to which the engagement fixture of the shoulder belt portion can be connected. Therefore, there is a merit of using the common component. That is, it is possible to reduce manufacturing costs of the buckle. In addition, it is possible to increase workability of attaching the buckle to which the engagement fixture is connected.

A third aspect of the present invention provides the wheelchair seatbelt device, in which in order to change the connection condition of the shoulder side support end of the shoulder belt portion from the temporary connection of the belt temporary fastening portion to the securely supportable connection of the final connection support portion, the belt temporary fastening portion is provided with a moving means that is configured to move the shoulder side support end of the shoulder belt portion temporarily connected to the belt temporary fastening portion to an extracting position that is positioned above or behind a temporarily connected position.

According to the wheelchair seatbelt device of the third aspect of the present invention, the belt temporary fastening portion is provided with the moving means that is configured to move the shoulder side support end of the shoulder belt portion temporarily connected to the belt temporary fastening portion to the extracting position that is positioned above or behind the temporarily connected position. Therefore, the shoulder side support end of the shoulder belt portion temporarily connected to the belt temporary fastening portion can be moved to the extracting position that is positioned above or behind the temporarily connected position by simply operating the moving means. Thus, when the connection condition of the shoulder side support end of the shoulder belt portion is changed from the temporary connection of the belt temporary fastening portion to the securely supportable connection of the final connection support portion, the shoulder side support end of the shoulder belt portion can be easily grasped.

A fourth aspect of the present invention provides the wheelchair seatbelt device, in which the moving means is a rotatable lever of which an intermediate portion is rotatably supported on a handrail provided to the platform, and in which an operating portion for rotationally operating the rotatable lever is provided to a proximal end side of the rotatable lever, the belt temporary fastening portion being provided to a distal end side of the rotatable lever.

According to the wheelchair seatbelt device of the fourth aspect of the present invention, when the rotatable lever is rotated by operating the operating portion of the rotatable lever, the belt temporary fastening portion can be moved to the position inside the vehicle in which it can be easily handled, so that the shoulder side support end temporarily connected to the belt temporary fastening portion can be moved to the position in which it can be easily handled. As a result, the moving means can be formed by a smaller number of parts. Therefore, it is possible to conveniently perform a belt application operation after the wheelchair is loaded in the vehicle while reducing bulk and weight thereof.

A fifth aspect of the present invention provides the wheelchair seatbelt device, in which the platform side support portion is positioned adjacent to the wheelchair placed on the platform in a width direction of the wheelchair, and in which the belt temporary fastening portion to which the shoulder side support end of the shoulder belt portion is temporarily connected is positioned in a side opposite to the platform side support portion such that the wheelchair placed on the platform can be positioned therebetween.

According to the wheelchair seatbelt device of the fifth aspect of the present invention, the belt temporary fastening portion to which the shoulder side support end of the shoulder belt portion is temporarily connected is positioned in the side opposite to the platform side support portion such that the wheelchair placed on the platform can be positioned therebetween. Therefore, when the shoulder side support end of the shoulder belt portion is temporarily connected to the belt temporary fastening portion, the shoulder belt portion can constrain the body of the wheelchair-sitting person, and can function as a waist seatbelt at the time of the lift-transferring of the platform.

According to the wheelchair seatbelt device of the first aspect of the present invention, a belt application operation can be simplified after the wheelchair is loaded in a vehicle while a columnar support member used in the conventional platform is abolished.

According to the wheelchair seatbelt device of the second aspect of the present invention, each of the belt temporary fastening portion and the final connection support portion is formed by a common component. Therefore, it is possible to reduce manufacturing costs of the component. In addition, it is possible to increase workability of attaching the component.

According to the wheelchair seatbelt device of the third aspect of the present invention, when the connection condition of the shoulder side support end of the shoulder belt portion from the temporary connection of the belt temporary fastening portion to the securely supportable connection of the final connection support portion, the shoulder side support end of the shoulder belt portion can be easily grasped.

According to the wheelchair seatbelt device of the fourth aspect of the present invention, the moving means can be formed by a smaller number of parts. Therefore, it is possible to conveniently perform a belt application operation after the wheelchair is loaded in the vehicle while reducing bulk and weight thereof.

According to the wheelchair seatbelt device of the fifth aspect of the present invention, when the shoulder side support end of the shoulder belt portion is temporarily connected to the belt temporary fastening portion, the shoulder belt portion can constrain the body of the wheelchair-sitting person, and can function as a waist seatbelt at the time of the lift-transferring of the platform.

MODE FOR CARRYING OUT THE INVENTION

First Practical Example

First, a first practical example will be described.

First Embodiment

In the following, a wheelchair seatbelt device according to a first embodiment, which is one of the best modes for carrying out the present invention, will be described with reference to the drawings.

Figure 1:
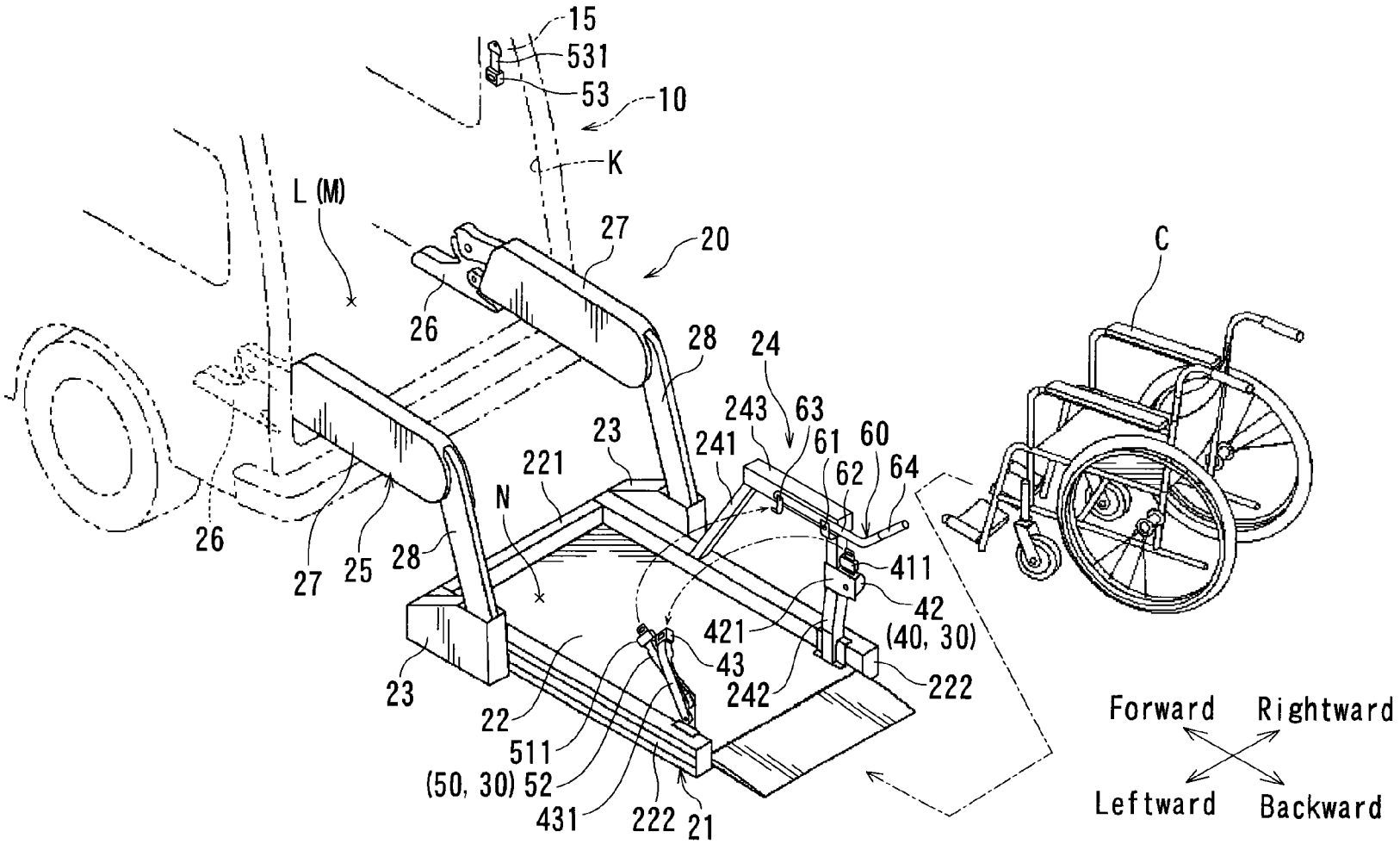
FIG. 1 is a rear side perspective view of a welfare vehicle relating to a first embodiment of a first practical example.
Figure 2:
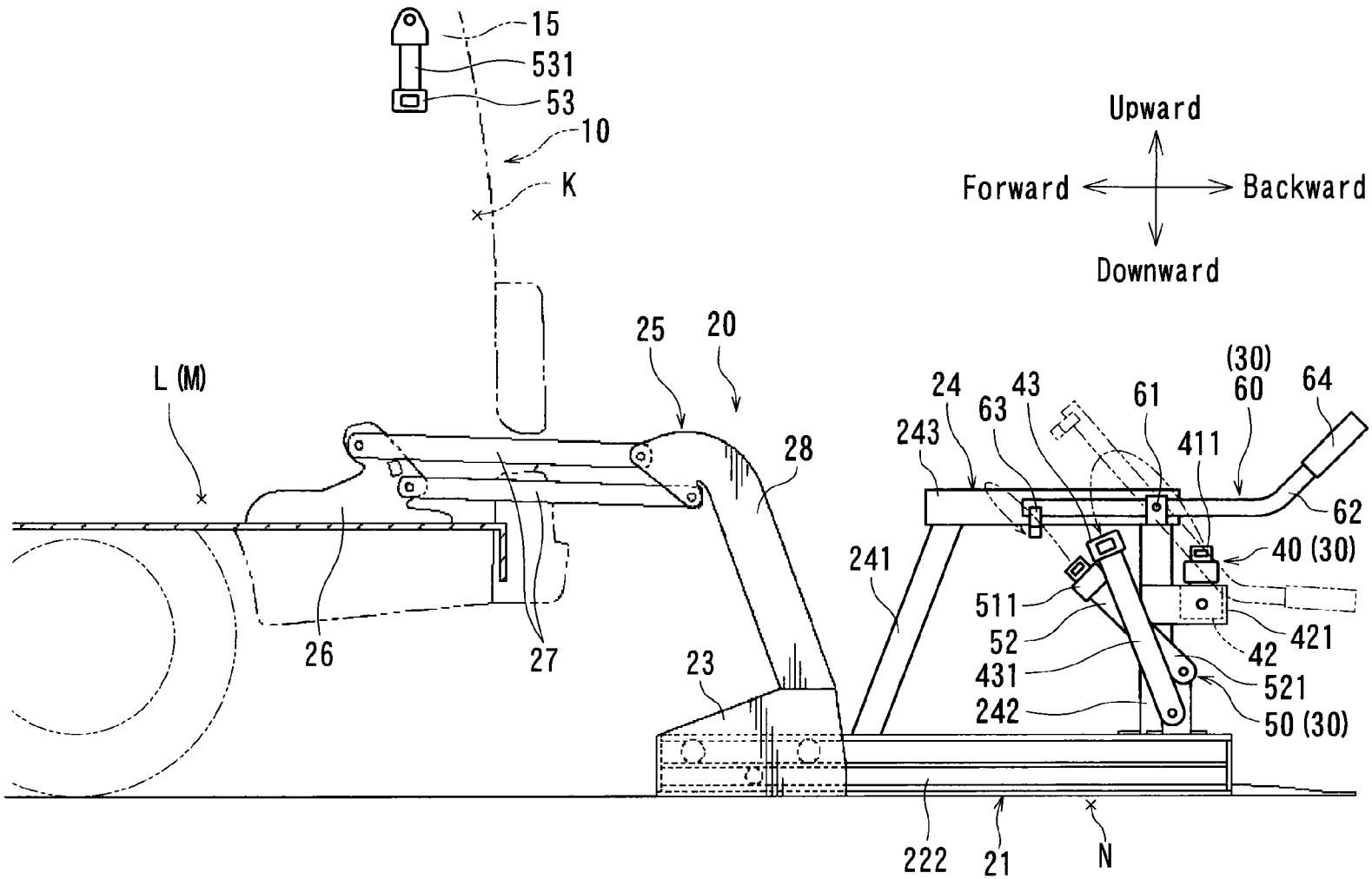
FIG. 2 is a rear side view of the welfare vehicle of FIG. 1.

FIG. 1 is a rear side perspective view of a welfare vehicle relating to a first embodiment of a first practical example. FIG. 2 is a rear side view of the welfare vehicle of FIG. 1.

The welfare vehicle 10 shown in FIGS. 1 and 2 is a vehicle that is capable of loading a wheelchair-sitting person P (not shown in FIGS. 1 and 2) sitting in a wheelchair C therein with the wheelchair C. The welfare vehicle 10 is shown in a condition in which a back door (not shown) is opened in order to load the wheelchair C therein. The wheelchair C shown therein is an ordinary one that is widely used. In the drawing, a symbol K indicates a door opening that is opened by opening the back door (not shown).

The welfare vehicle 10 has a wheelchair lifting and transferring device 20 that is capable of loading the wheelchair-sitting person P with the wheelchair C therein. The wheelchair lifting and transferring device 20 generally has a platform 21 and a lifting and transferring mechanism 25.

The platform 21 is configured such that the wheelchair C can be placed thereon, and has a flat plate-shaped carrying plate 22 on which the wheelchair C is placed and a slide mechanism 23 for sliding the carrying plate 22. The carrying plate 22 has an upwardly projected wheelchair stopper portion 221 that is formed in a front side thereof. The carrying plate 22 has slide rails 222 that are formed in right and left sides of the carrying plate 22 and are shaped to be guided by the slide mechanism 23. The slide mechanism 23 is configured to slide-transfer the platform 21 together with the slide rails 222. This slide-transferring can be performed along with lift-transferring of the platform 21 caused by the lifting and transferring mechanism 25, which will be hereinafter described.

Further, as also shown in FIG. 2, the platform 21 has a handrail 24 that is provided to the right side slide rail 222. The hand rail 24 is provided to the right side slide rail 222 provided to the platform 21. The handrail 24 has two pillar portions 241 and 242 that are provided in front and rear positions in the drawing, and a grip portion 243 that connects upper portions of the two pillar portions 241 and 242 to each other. The handrail 24 thus formed may function as not only a handrail for the wheelchair-sitting person P but also an armrest.

The lifting and transferring mechanism 25 is configured to lift-transfer the platform 21 from a getting in/out position in a vehicle exterior N to a loading position in a vehicle interior M. The getting in/out position in the vehicle exterior N of the platform 21 corresponds to a position of the platform 21 as shown in FIGS. 1 and 2. In contrast, although not shown in detail, the loading position in the vehicle interior M of the platform 21 corresponds to a position of the platform 21 in which the platform 21 is seated on a vehicle floor L in the vehicle interior M. This position corresponds to a set position after the platform 21 is lift-transferred by the lifting and transferring mechanism 25, which will be hereinafter described. Generally, the lifting and transferring mechanism 25 has stationary support portions 26, first link portions 27, and second link portions 28. The stationary support portions 26 are portions that are fixed inside the welfare vehicle 10, and are configured to rotatably support the first link portions 27. Each first link portion 27 is a four-joint link having four joints in which one end thereof is rotatably supported on the stationary support portion 26 and in which the other end thereof rotatably supports the second link portion 28. On end of each second link portion 28 is rotatably supported on the first link portion 27, and the other end of each second link portion 28 rotatably supports the slide mechanism 23. Thus, the lifting and transferring mechanism 25 can lift-transfer the platform 21 from the getting in/out position in the vehicle exterior N to the loading position in the vehicle interior M. When the platform 21 is lift-transferred by the lifting and transferring mechanism 25, the platform 21 can be slide-transferred by the slide mechanism 23.

The wheelchair lifting and transferring device 20 constructed as described above and configured to load the wheelchair C in the vehicle interior M has a wheelchair seatbelt device 30. The wheelchair seatbelt device 30 is configured to constrain the body of the wheelchair-sitting person P (not shown in FIGS. 1 and 2) sitting in the wheelchair C to be loaded in the vehicle.

Figure 3:
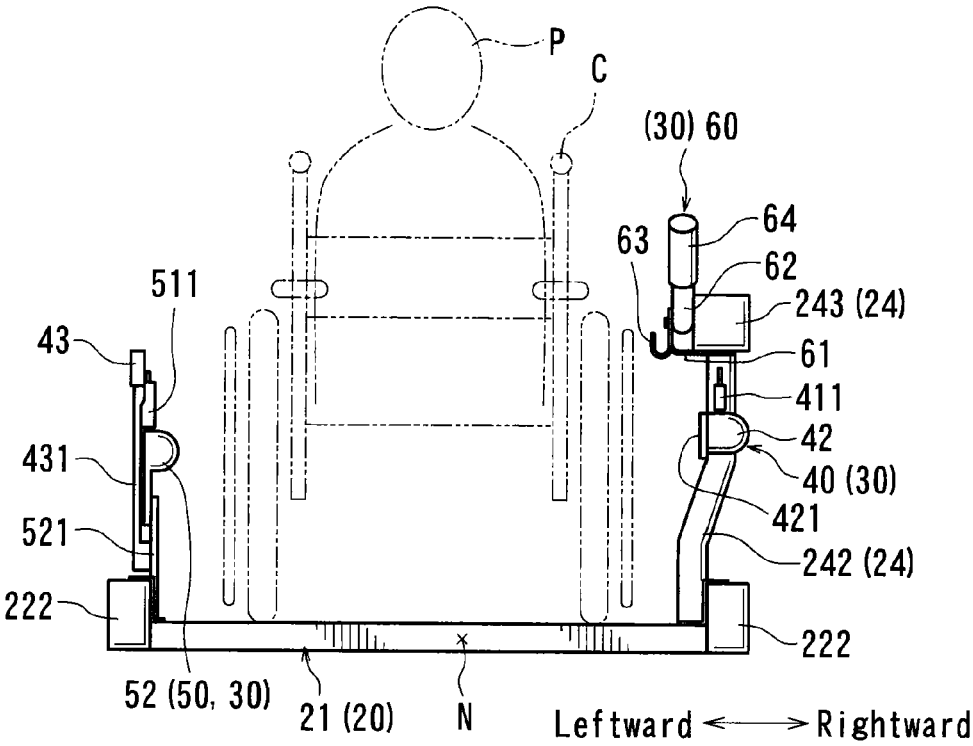
FIG. 3 is a schematic rear view of a wheelchair seatbelt device shown in FIG. 1, which shows a first condition thereof.
Figure 4:
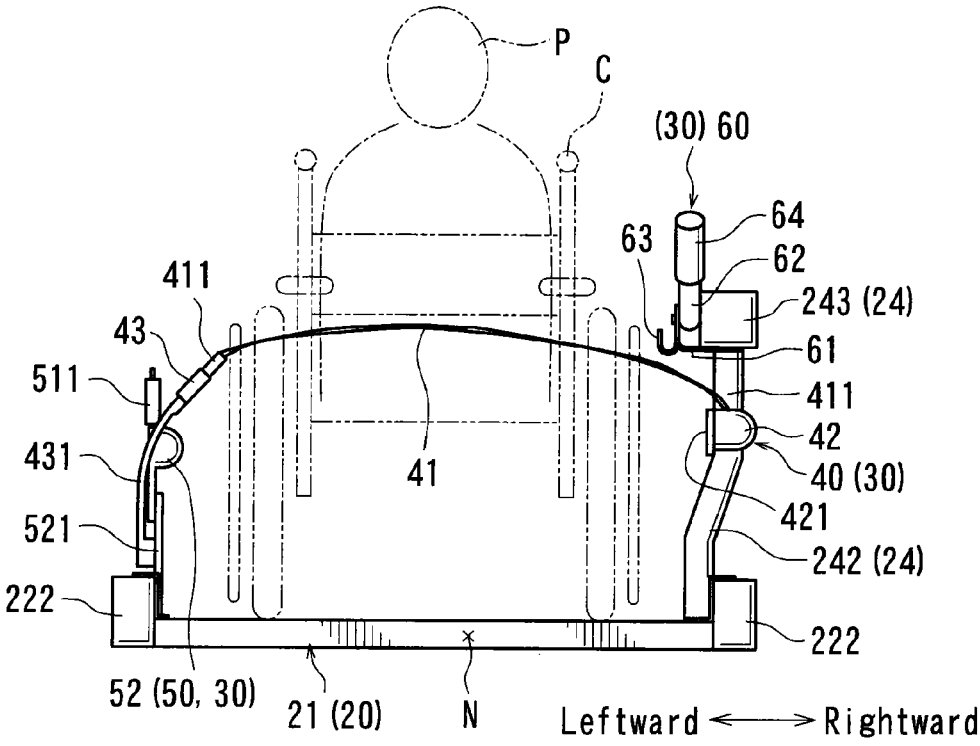
FIG. 4 is a schematic rear view of the wheelchair seatbelt device shown in FIG. 1, which shows a second condition thereof.
Figure 5:
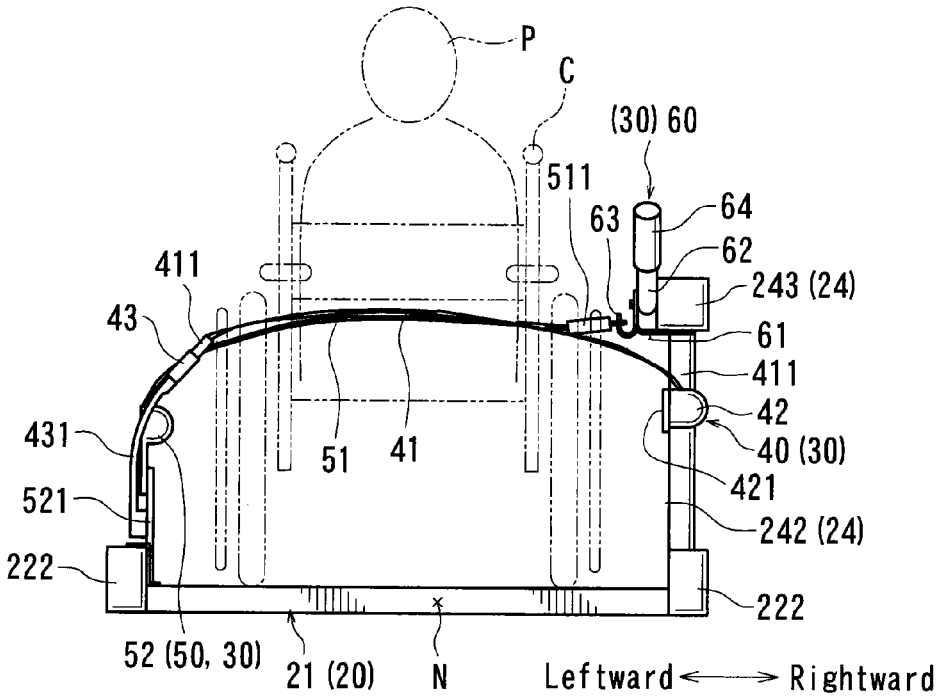
FIG. 5 is a schematic rear side view of the wheelchair seatbelt device shown in FIG. 1, which shows a third condition thereof.
Figure 6:
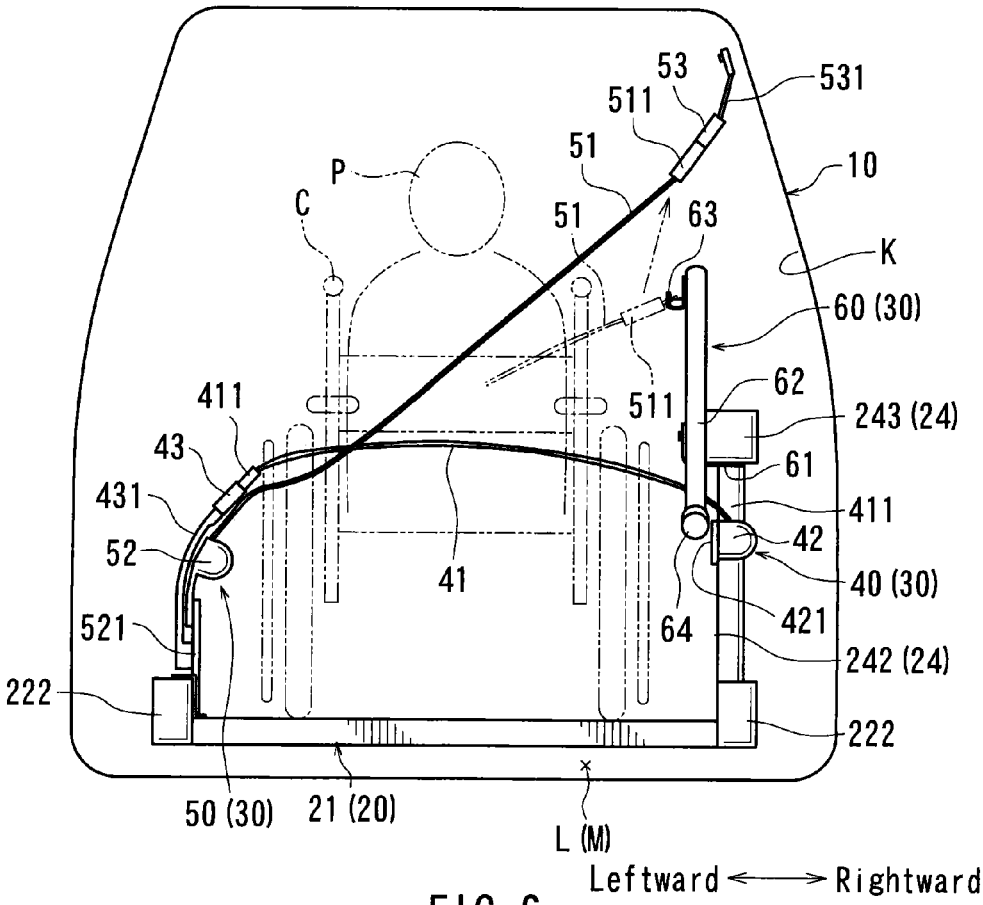
FIG. 6 is a schematic rear side view of the wheelchair seatbelt device shown in FIG. 1, which shows a fourth condition thereof.

As shown in FIGS. 1 and 2, the wheelchair seatbelt device 30 has a wrap belt device 40, a shoulder belt device 50 and a belt temporary fastening member 60. FIGS. 3 to 6 are rear side schematic views of the platform 21 including the wheelchair seatbelt device 30 in the welfare vehicle 10. Further, in FIGS. 3 to 6, a belt application process to the wheelchair-sitting person P in the wheelchair seatbelt device 30 is shown sequentially. More specifically, FIG. 3 shows a first condition of the belt application process in the wheelchair seatbelt device 30. FIG. 4 shows a second condition of the belt application process in the wheelchair seatbelt device 30. FIG. 5 shows a third condition of the belt application process in the wheelchair seatbelt device 30. FIG. 6 shows a fourth condition of the belt application process in the wheelchair seatbelt device 30.

That is, as shown in FIG. 4 and others, the wrap belt device 40 is a device for constraining the waist of the wheelchair-sitting person P by a wrap belt 41. Generally, the wrap belt device 40 has the wrap belt 41, a refractor 42 and an engagement buckle 43.

The wrap belt 41 corresponds to a wrap belt portion of the present invention. The wrap belt 41 is arranged to extend around the waist of the wheelchair-sitting person P so as to constraint the waist of the wheelchair-sitting person P. A proximal end side of the wrap belt 41 is constructed to be taken up by the retractor 42. Further, attached to a distal end side of the wrap belt 41 is an engagement fixture 411 that is capable of engaging the engagement buckle 43.

The retractor 42 is an ordinary seatbelt retractor that is widely used. As shown in FIG. 1 and others, the retractor 42 is fixed to the right side of the platform 21. In particular, the retractor 42 is fixed to a column portion 242 of the handrail 24 fixed to the right side of the platform 21 via a bracket 421.

To the contrary, as shown in FIG. 1 and others, the engagement buckle 43 is fixed to the left side of the platform 21. The engagement buckle 43 is a member for engaging the engagement fixture 411 of the wrap belt 41 that is drawn from the retractor 42. The engagement buckle 43 is fixed to the platform 21 via an attachment belt 431 that is fixed thereto as appropriate.

As shown in FIG. 4 and others, when the engagement fixture 411 is connected to the engagement buckle 43, the wrap belt 41 extends around the waist of the wheelchair-sitting person P so as to constrain the waist of the wheelchair-sitting person P. Thus, the wrap belt portion of the seat belt can be applied thereto.

As also shown in FIG. 6 and others, the shoulder belt device 50 is a device for constraining the upper half of the body of the wheelchair-sitting person P by a shoulder belt 51. Generally, the shoulder belt device 50 has the shoulder belt 51, a retractor 52 and an engagement buckle 53. The engagement buckle 53 is disposed in the vehicle interior M and not attached to the platform 21, which will be hereinafter described. The engagement buckle 53 has the same construction as the engagement buckle 43 described above that is formed as a common component.

The shoulder belt 51 corresponds to a shoulder belt portion of the present invention. The shoulder belt 51 is arranged to extend obliquely from the shoulder to the waist of the wheelchair-sitting person P, so as to constrain the upper half of the body of the wheelchair-sitting person P. A proximal end side of the shoulder belt 51 is constructed to be taken up by the retractor 52. Attached to a distal end side of the shoulder belt 51 is an engagement fixture 511 that is capable of engaging the engagement buckle 53. The engagement fixture 511 of the shoulder belt 51 is a portion corresponding to a shoulder side support end of the shoulder belt portion of the present invention.

Similar to the retractor 42 described above, the refractor 52 is an ordinary seatbelt retractor that is widely used. As also shown in FIG. 1 and others, the retractor 52 is secured to the left side of the platform 21 while it is positioned adjacent to the wheelchair C placed on the platform 21 in a width direction of the wheelchair C. In particular, the retractor 52 is fixed to the platform 21 via an attachment belt 521 that is fixed thereto as appropriate. The refractor 52 is a portion corresponding to a platform side support portion of the present invention that is disposed the platform 21 of the wheelchair lifting and transferring device 20. Thus, a portion of the shoulder belt 51 that is positioned near the retractor 52 corresponds to a waist side support end of the shoulder belt portion of the present invention.

To the contrary, as shown in FIGS. 1 and 2, the engagement buckle 53 is disposed in the vehicle interior M of the welfare vehicle 10. The engagement buckle 53 is a member for engaging an engagement fixture 511 of the shoulder belt 51 that is drawn from the retractor 52. The buckle 53 is secured to a rear pillar portion 15 positioned in the right side of the vehicle interior M of the welfare vehicle 10 via an attachment belt 531.

As shown in FIG. 6 and others, when the engagement fixture 511 is connected to the engagement buckle 53, the shoulder belt 51 extends obliquely from the shoulder to the waist of the wheelchair-sitting person P so as to constrain the upper half of the body of the wheelchair-sitting person P. Thus, the shoulder belt portion of the seatbelt can be applied. The engagement buckle 53 is a portion corresponding to a final connection support portion disposed in a vehicle interior of the present invention. That is, upon connection of the engagement fixture 511 as the shoulder side support end of the shoulder belt 51 to the engagement buckle 53, the shoulder belt 51 is securely supportably connected to and supported by this engagement buckle 53.

Next, the belt temporary fastening member 60 will be described. The belt temporary fastening member 60 is a member to which the engagement fixture 511 as the shoulder side support end of the shoulder belt 51 can be temporarily connected when the platform 21 is positioned in the getting in/out position in the vehicle exterior N.

As shown in FIGS. 1 and 2, the belt temporary fastening member 60 is provided to the grip portion 243 of the handrail 24 described above. The belt temporary fastening member 60 has a rotationally supportable connection portion 61 that is positioned in a rear end side of the grip portion 243, a rotatable lever 62 that is rotatably supported by the rotationally supportable connection portion 61, and a temporary fastening fixture 63 that is disposed in a front end side of the rotatable lever 62.

In particular, the rotationally supportable connection portion 61 is attached to the handrail 24 so as to be positioned in an inner side of the platform 21 (in the left side of the grip portion 243 shown therein). The rotationally supportable connection portion 61 is formed to have an appropriate bracket shape, so as to rotatably support an intermediate portion of the rotatable lever 62.

The rotatable lever 62 is made by bending a round bar in a lever-like fashion, and an intermediate portion thereof is rotatably supported by the rotationally supportable connection portion 61. Thus, the rotatable lever 62 is rotatably supported on the handrail 24. The rotatable lever 62 is a portion corresponding to a moving means of the present invention. The rotatable lever 62 is a member that functions to move the engagement fixture 511 (the shoulder side support end) of the shoulder belt 51 temporarily connected to a temporary fastening fixture 63, which will be hereinafter described, from a temporarily connected position to an upper rearward extracting position (a position indicated by chain double-dashed line in FIG. 6) in which it can be easily grasped. The upper rearward extracting position is set to a position in which when the platform 21 is positioned in the getting in/out position in the vehicle interior M, a loading assistant behind the platform 21 on which the wheelchair C is placed can easily grasp the engagement fixture 511 temporarily connected to the temporary fastening fixture 63. Thus, in order to change a connection condition of the engagement fixture 511 from a temporary connection in which it is temporary connected to the temporary fastening fixture 63 (a belt temporary fastening portion) to a securely supportable connection in which it is connected to the engagement buckle 53 (the final connection support portion), the loading assistant behind the platform 21 can easily grasp the engagement fixture 511 (the shoulder side support end) of the shoulder belt 51 temporarily connected to the temporary fastening fixture 63, which will be herein after described.

The temporary fastening fixture 63 as the belt temporary fastening portion of the present invention is provided to a distal end side of the rotatable lever 62, which side is coincide with a front end side as seen in the drawing. The temporary fastening fixture 63 is positioned in a side opposite to the retractor 52 such that the wheelchair C placed on the platform 21 can be positioned therebetween. The temporary fastening fixture 63 is provided to the rotatable lever 62 so as to be positioned in the inner side (the left side of the rotatable lever 62 shown therein) of the platform 21. As shown in the drawing, the temporary fastening fixture 63 has an appropriate hook shape such that the engagement fixture 511 of the shoulder belt 51 can be hooked thereon. That is, when the platform 21 is positioned in the getting-in/of position in the vehicle exterior N, the engagement fixture 511 of the shoulder belt 51 as the shoulder side support end can be temporarily connected to the temporary fastening fixture 63 as the belt temporary fastening portion, so as to be temporarily fastened thereto.

Conversely, an operating portion 64 for rotationally operating the rotatable lever 62 is provided to a rear end side of the rotatable lever 62, which side is coincide with a proximal end side. This operating portion 64 is constructed such that the loading assistant can grasp and operate the same from behind the platform 21 on which the wheelchair C is placed when the platform 21 is positioned in the loading position in the vehicle interior N due to the lift-transferring of the platform 21 caused by the lifting and transferring mechanism 25.

Next, the belt application process of the wheelchair seatbelt device 30 of the first embodiment described above will be illustrated with reference to FIGS. 3 to 6. In the first condition of the belt application process to the third condition of the belt application process shown in FIGS. 3 to 5, an operation can be performed in a condition in which the platform 21 is positioned in the getting in/out position in the vehicle exterior N before the platform 21 is lift-transferred by the lifting and transferring mechanism 25. To the contrary, in the fourth condition of the belt application process shown in FIG. 6, an operation can be performed in a condition in which the platform 21 is positioned in the loading position in the vehicle interior M (seated on the vehicle floor L) after the platform 21 is lift-transferred by the lifting and transferring mechanism 25.

In the first condition of the belt application process shown in FIG. 3, the wheelchair C is placed on the platform 21. In this first condition of the belt application process, the wrap belt 41 and the shoulder belt 51 are respectively retracted in the refractors 42 and 52.

In the second condition of the belt application process shown in FIG. 4, only the wrap belt 41 is applied to the wheelchair-sitting person P. In the second condition of the belt application process, the wrap belt 41 is drawn from the retractor 42, and the engagement fixture 411 of the wrap belt 41 is connected to the engagement buckle 43. As a result, the wrap belt 41 extends around the waist of the wheelchair-sitting person P so as to constrain the waist of the wheelchair-sitting person P. Thus, the wrap belt portion of the seat belt can be applied to the wheelchair-sitting person P. Further, although hard to see in the drawing, the wrap belt 41 is passed between spokes of wheels of the wheelchair C and passed under the armrest of the wheelchair C, so as to suitably constrain the waist portion of the wheelchair-sitting person P.

In the third condition of the belt application process shown in FIG. 5, the engagement fixture 511 of the shoulder belt 51 is temporarily connected to the temporary fastening fixture 63 of the belt temporary fastening member 60. In this third condition of the belt application process, the shoulder belt 51 is drawn from the retractor 52, and the engagement fixture 511 of this shoulder belt 51 is hooked on the temporary fastening fixture 63, so as to be temporary connected thereto. Further, although hard to see in the drawing, the shoulder belt 51 in a side of the refractor 52 (the left side as seen in the drawing) is passed between the wheel spokes of the wheelchair C and is passed under the armrest of the wheelchair C, so as to suitably constrain the upper half of the body of the wheelchair-sitting person P.

In the fourth condition of the belt application process shown in FIG. 6, the engagement fixture 511 is engaged with the engagement buckle 53 (the final connection support portion) in the vehicle interior M. That is, the connection condition of the engagement fixture 511 of the shoulder belt 51 is changed from the temporary connection in which it is temporarily fastened to the temporary fastening fixture 63 of the belt temporary fastening member 60 to the securely supportable connection in which it is securely supported by the engagement buckle 53 in the vehicle interior M. At this time, as described above, the platform 21 is lift-transferred by the lifting and transferring mechanism 25, so that the platform 21 is positioned in the loading position in the vehicle interior M. As shown in FIG. 6, when the loading assistant (not shown) behind the wheelchair C loaded in the vehicle grasps and operates the operating portion 64 of the rotatable lever 62 described above, the temporary fastening fixture 63 of the belt temporary fastening member 60 can move upwards and backwards. As a result, the engagement fixture 511 of the shoulder belt 51 hooked on this temporary fastening fixture 63 can also move from the temporarily connected position to the upper rearward extracting position. Thus, the engagement fixture 511 can be moved to the upper rearward extracting position (indicted by the chain double-dashed line in FIG. 6) in which it can be easily grasped by the loading assistant. Therefore, the loading assistant can grasp and hold this engagement fixture 511, so that the connection condition of the engagement fixture 511 can be changed to the securely supportable connection in which it is securely supported by the engagement buckle 53 in the vehicle interior M. That is, the loading assistant can connect the engagement fixture 511 of the shoulder belt 51 to the engagement buckle 53 in the vehicle interior M.

According to the wheelchair seatbelt device 30 of the first embodiment described above, the following effects can be obtained.

That is, according to the wheelchair seatbelt device 30 described above, the engagement fixture 511 of the shoulder belt 51 is connected to and supported by the engagement buckle 53 disposed in the vehicle interior M. Thus, there is an effect that the body of the wheelchair-sitting person P loaded in the vehicle by the wheelchair lifting and transferring device 20 can be constrained while a columnar support member used in the conventional platform 21 can be abolished. Due to the abolishment of the columnar support member, various advantages are obtained. For example, it is possible to achieve an improvement in balance of the platform 21 and a reduction in weight and cost. Further, a wheelchair loading area on the platform 21 can be increased. As a result, for example, the loading assistant can easily perform a threading operation of the belts. Further, it is possible to provide a satisfactory field of vision in the rear side of the vehicle and to enlarge an acceptable range regarding the kind of wheelchair to be seated thereon.

In addition, because the temporary fastening fixture 63 is attached to the platform 21, when the platform 21 is positioned in the getting in/out position in the vehicle exterior N before it is lift-transferred by the lifting and transferring mechanism 25, the engagement fixture 51 of the shoulder belt 51 can be temporarily connected to this temporary fastening fixture 63. To the contrary, when the platform 21 is positioned in the loading position in the vehicle interior M due to lift-transferring by the lifting and transferring mechanism 25, the connection condition of the engagement fixture 51 of the shoulder belt 51 can be changed from the temporary connection to the temporary fastening fixture 63 to the securely supportable connection to the engagement buckle 53 disposed in the vehicle interior M. Therefore, it is possible to thread the shoulder belt 51 between the spokes of the wheel and to thread the shoulder belt under the armrest of the wheelchair C such that the shoulder belt 51 can reliably contact the body of the wheelchair-sitting person P when the platform 21 is positioned in the getting in/out position in the vehicle exterior N, and it is possible to temporarily keep the engagement fixture 51 in this condition. Thereafter, when the platform 21 is positioned in the loading position in the vehicle interior M, it is only necessary to perform the simple operation of changing the connection condition of the engagement fixture 51 from the temporary connection to the temporary fastening fixture 63 to the securely supportable connection to the engagement buckle 53 disposed in the vehicle interior M.

According to the wheelchair seatbelt device 30 described above, the temporary fastening fixture 63 is provided with a moving means for moving the engagement fixture 51 of the shoulder belt 51 temporarily connected to the temporary fastening fixture 63 to the upper rearward extracting position in which it can be easily grasped. Therefore, the engagement fixture 51 of the shoulder belt 51 temporarily connected can be moved from the temporarily connected position to the upper rearward extracting position in which it can be easily grasped by simply moving the same using this moving means. Thus, when the connection condition is changed from the temporary connection in which the engagement fixture 51 of the shoulder belt 51 is temporary connected to the temporary fastening fixture 63 to the securely supportable connection in which it is securely supported by the engagement buckle 53, it is easily grasp the engagement fixture 51 of the shoulder belt 51.

According to the wheelchair seatbelt device 30 described above, when the rotatable lever 62 is rotated by operating the operating portion 64 of the rotatable lever 62, the temporary fastening fixture 63 can be moved to the position inside the vehicle in which it can be easily handled. Thus, the engagement fixture 51 temporarily connected to the temporary fastening fixture 63 can be moved to the position in which it can be easily handled. As a result, the rotatable lever 62 can be formed by a smaller number of parts. Therefore, it is possible to conveniently perform a belt application operation after the wheelchair C is loaded in the vehicle while reducing bulk and weight thereof.

Second Embodiment

In the following, a wheelchair seatbelt device according to a second embodiment, which device has a different construction from the wheelchair seatbelt device 30 described above and is one of the best modes for realizing a wheelchair seatbelt device according to the present invention, will be described with reference to the drawings. In this second embodiment, elements having the same construction as those described in relation to the first embodiment will be identified by the same reference numerals and a detailed description of such elements will be omitted.

Figure 7:
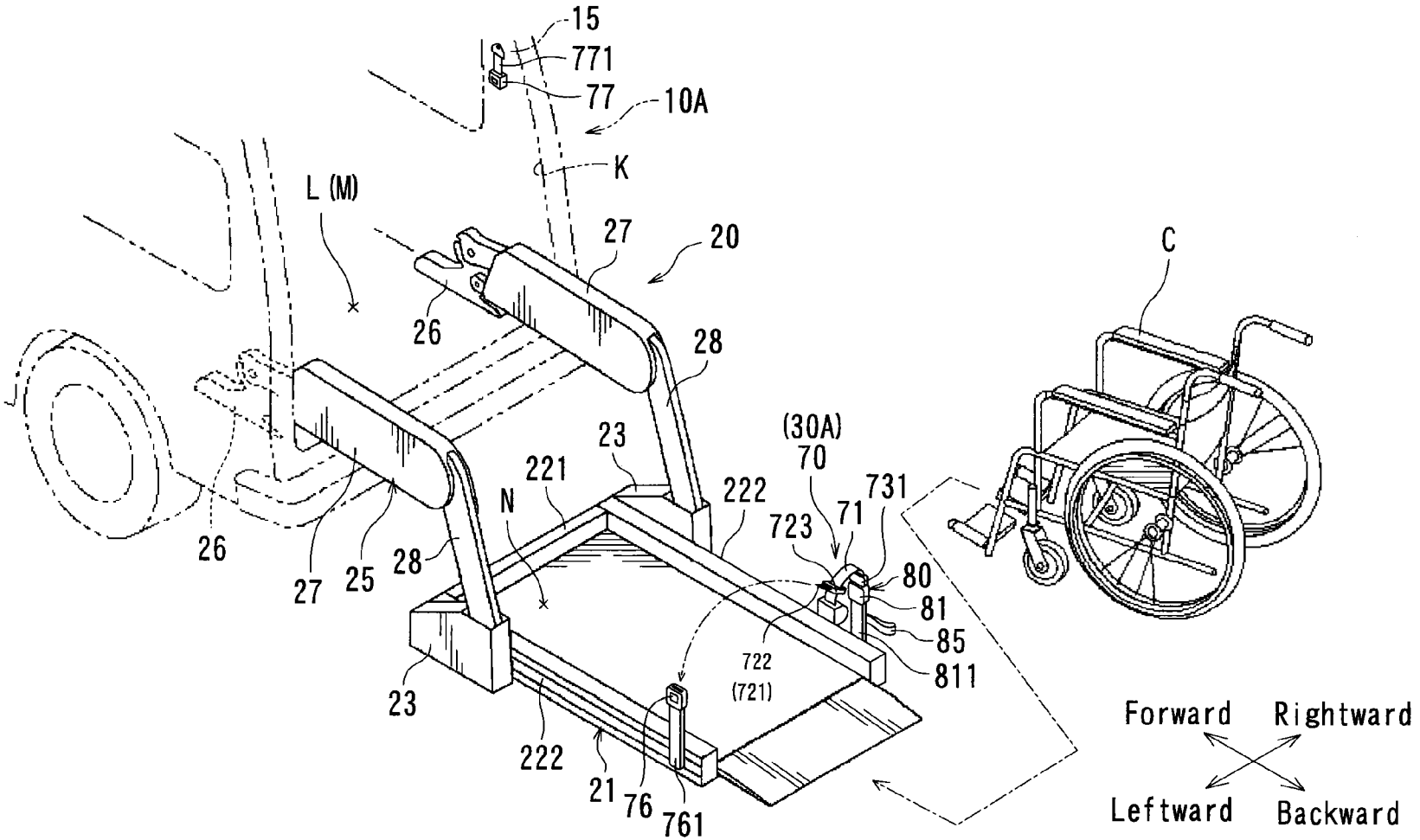
FIG. 7 is a rear side perspective view of a welfare vehicle relating to a second embodiment.
Figure 8:
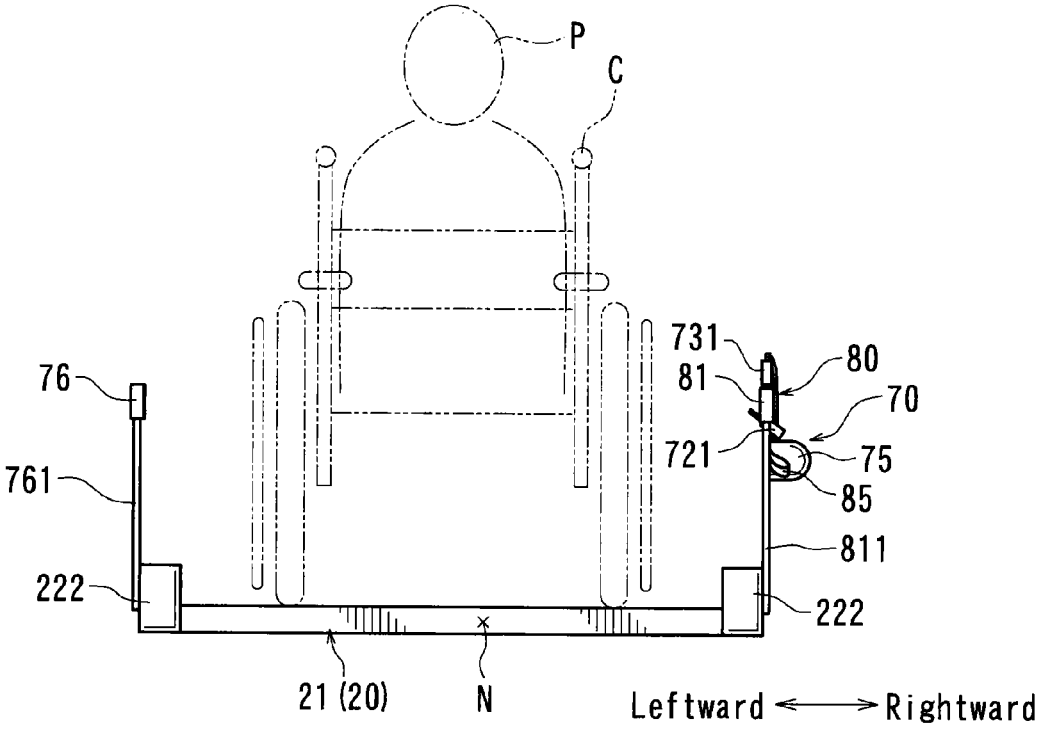
FIG. 8 is a schematic rear side view of a first condition of a wheelchair seatbelt device shown in FIG. 7.
Figure 9:
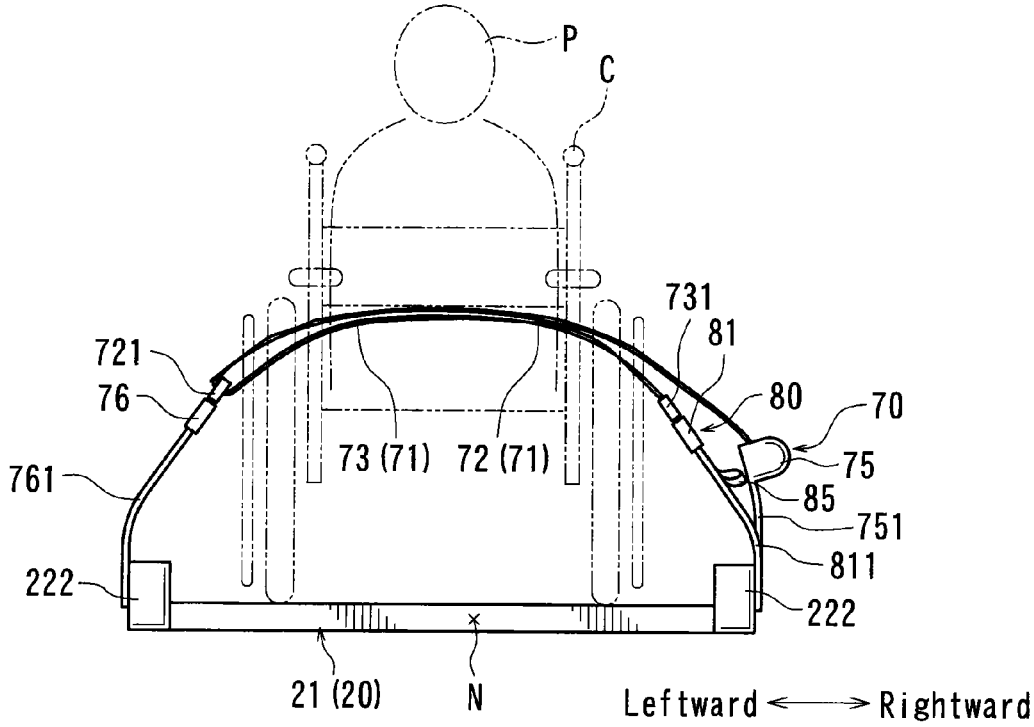
FIG. 9 is a schematic rear side view of a second condition of the wheelchair seatbelt device of FIG. 7.
Figure 10:
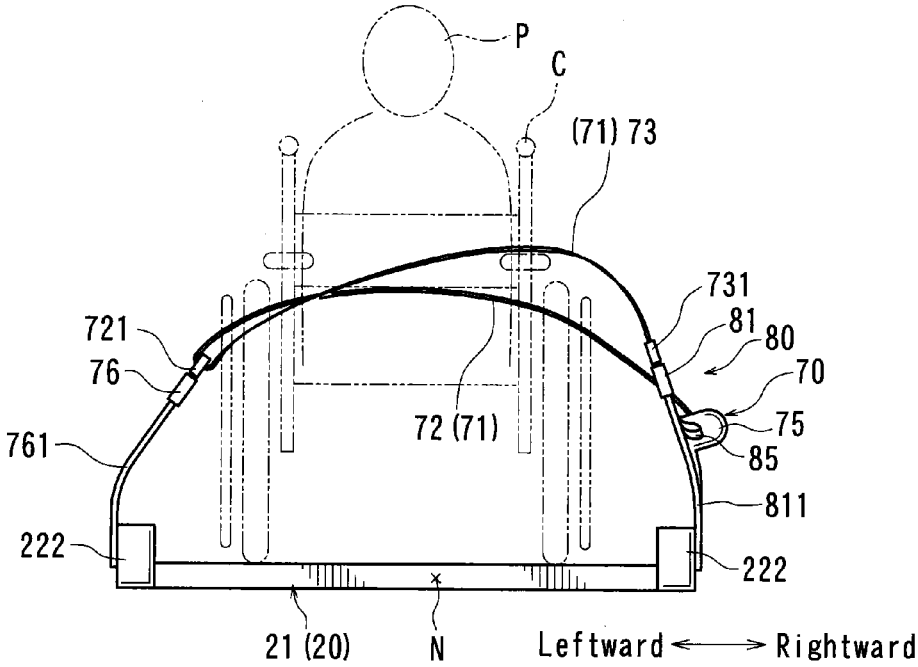
FIG. 10 is a schematic rear side view of a third condition of the wheelchair seatbelt device shown in FIG. 7.
Figure 11:
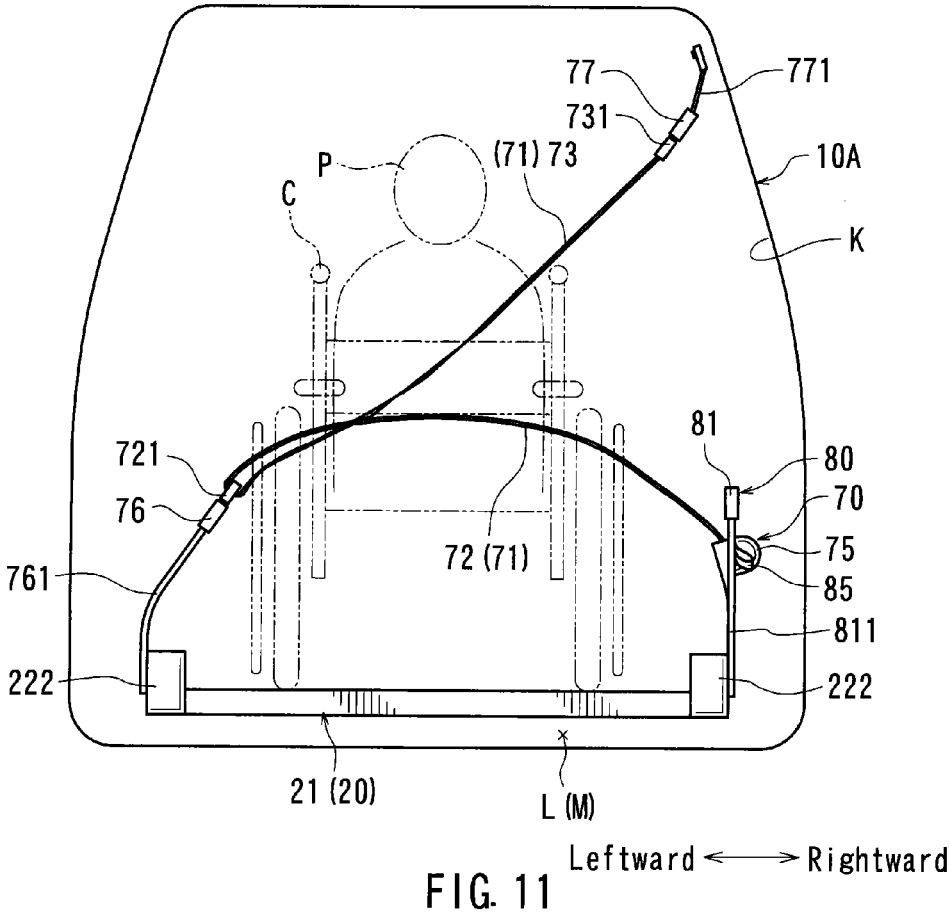
FIG. 11 is a schematic rear side view of a fourth condition of the wheelchair seatbelt device shown in FIG. 7.

FIG. 7 is a rear side perspective view of a welfare vehicle 10A relating to a second embodiment. Further, FIGS. 8 to 11 are rear side schematic views of the platform 21 including the wheelchair seatbelt device 30A in the welfare vehicle 10A, in which a belt application process to the wheelchair-sitting person P is shown sequentially. More specifically, FIG. 8 shows a first condition of the belt application process in the wheelchair seatbelt device 30A. FIG. 9 shows a second condition of the belt application process in the wheelchair seatbelt device 30A. FIG. 10 shows a third condition of the belt application process in the wheelchair seatbelt device 30A. FIG. 11 shows a fourth condition of the belt application process in the wheelchair seatbelt device 30A.

As shown in the drawings, in the wheelchair seatbelt device 30A, a wrap belt portion 72 and a shoulder belt portion 73 are formed by a single webbing 71. That is, as shown in FIG. 11 and others, the wheelchair seatbelt device 30A generally has a belt device 70 and a belt temporary fastening member 80.

In the belt device 70, the single webbing 71 functions as the wrap belt portion 72 and the shoulder belt portion 73. The belt device 70 generally has the webbing 71, a retractor 75, a first engagement buckle 76 and a second engagement buckle 77.

The webbing 71 is formed similar to a webbing of a widely used three-point type seatbelt. The webbing 71 is provided with two engagement fixtures 721 and 731, so as to be divided into the wrap belt portion 72 and the shoulder belt portion 73 in function.

That is, an intermediate portion of the webbing 71 drawn from the retractor 75 is provided with the first engagement fixture 721 that is capable of engaging the first engagement buckle 76. The first engagement fixture 721 has a loop portion 723 with which a fixture main body 722 engageable with the first engagement buckle 76 is integrated. The loop portion 723 is capable of movably receiving the webbing 71 therethrough. Thus, the first engagement fixture 721 can be positioned in any positions on the webbing 71 due to this loop portion 723, so that the fixture main body 722 can be connected to the first engagement buckle 76 while the webbing 71 is grasped (pulled). Further, the first engagement fixture 721 is a portion corresponding to the waist side support end of the shoulder belt portion according to the present invention.

Attached to a distal end side of the webbing 71 is the second engagement fixture 731 that is capable of engaging the second engagement buckle 77. The second engagement fixture 731 is formed similar to the engagement fixture 511 of the shoulder belt 51 of the first embodiment, and is a portion corresponding to the shoulder side support end of the shoulder belt portion according to the present invention.

Similar to the retractors 42 and 52, the retractor 75 is an ordinary seatbelt retractor that is widely used. As also shown in FIG. 7 and others, the retractor 75 is fixedly connected to the right side of the platform 21. In particular, as also shown in FIG. 9 and others, the refractor 75 is fixedly attached via an attachment bracket 751 that is secured to the platform 21 as appropriate.

To the contrary, as also shown in FIG. 7 and others, the first engagement buckle 76 is fixedly connected to the left side of the platform 21. This first engagement buckle 76 functions to engage the first engagement fixture 721 of the webbing 71 drawn from the retractor 75, and is positioned adjacent to the wheelchair C placed on the platform 21 in a width direction of the wheelchair C. This first engagement buckle 76 is securely attached to the platform 21 via an attachment belt 761 secured to the platform 21 as appropriate. As shown in FIG. 9 and others, when the first engagement fixture 721 is connected to the first engagement buckle 76, a part of the webbing 71 extends around the waist of the wheelchair-sitting person P so as to constrain the waist of the wheelchair-sitting person P. Thus, the part of the webbing 71 functions as the wrap belt portion 72, so that the wrap belt portion of the seatbelt can be applied.

Further, as shown in FIGS. 7 and 11, the second engagement buckle 77 is disposed in the vehicle interior M of the welfare vehicle 10A. This second engagement buckle 77 functions to engage the second engagement fixture 731 of the shoulder belt portion 73 drawn from the retractor 75. This second engagement buckle 77 is fixedly attached to a rear pillar 15 positioned in the right side of the vehicle interior M of the welfare vehicle 10A via an attachment belt 771. As shown in FIG. 11 and others, when the second engagement fixture 731 is connected to the second engagement buckle 77, a part of the webbing 71 extends obliquely from the shoulder to the waist of the wheelchair-sitting person P so as to constrain the upper half of the body of the wheelchair-sitting person P. Thus, a part of the webbing 71 functions as the shoulder belt portion 73, so that the shoulder belt portion of the seatbelt may be applied.

Next, the belt temporary fastening member 80 will be described. This belt temporary fastening member 80 is a member to which the second engagement fixture 731 as the shoulder side support end of the shoulder belt portion 73 can be temporarily connected when the platform 21 is positioned in the getting in/out position in the vehicle exterior N.

As shown in FIGS. 7 and 10, this belt temporary fastening member 80 generally has a temporary engagement buckle 81 as the belt temporary fastening portion of the present invention, and a drawing strap portion 85 positioned to draw this temporary engagement buckle 81.

The temporary engagement buckle 81 has a buckle structure that is capable of engaging the second engagement fixture 731. This temporary engagement buckle 81 is positioned in a side opposite to the first engagement buckle 76 such that the wheelchair C placed on the platform 21 can be positioned therebetween. As shown in FIG. 7 and others, this temporary engagement buckle 81 is securely positioned in the right side of the platform 21 while being positioned adjacent to the retractor 75 described above. As shown in FIGS. 7 and 8, the temporary engagement buckle 81 is normally engaged with the second engagement fixture 731 and securely connected to the platform 21 via an attachment belt 811 secured to the platform 21 as appropriate. This temporary engagement buckle 81 is formed as a common component and has the same structure as the first engagement buckle 76 and the second engagement buckle 77 described above.

The drawing strap portion 85 is a strap having an appropriate ring-like configuration and is connected to the above-mentioned attachment belt 811. Therefore, when this drawing strap portion 85 is pulled, the temporary engagement buckle 81 described above is also pulled in conjunction with the attachment belt 811. A connecting position of the drawing strap portion 85 to the attachment belt 811 is set to a position in close proximity to the temporary engagement buckle 81 such that the temporary engagement buckle 81 can be easily pulled in conjunction with a pulling motion of the drawing strap portion 85.

Next, the belt application process of the wheelchair seatbelt device 30A according to the second embodiment described above will be illustrated with reference to FIGS. 8 to 11. In the first condition of the belt application process to the third condition of the belt application process shown in FIGS. 8 to 11, an operation can be performed in a condition in which the platform 21 is positioned in the getting in/out position in the vehicle exterior N before the platform 21 is lift-transferred by the lifting and transferring mechanism 25. To the contrary, in the fourth condition of the belt application process shown in FIG. 11, an operation can be performed in a condition in which the platform 21 is positioned in the loading position in the vehicle interior M (seated on the vehicle floor L) after the platform 21 is lift-transferred by the lifting and transferring mechanism 25.

In the first condition of the belt application process shown in FIG. 8, the wheelchair C is placed on the platform 21. In this first condition of the belt application process, the webbing 71 (72, 73) is kept retracted in the retractor 75. At this time, the second engagement fixture 731 attached to the distal end side of the webbing 71 (72, 73) engages the temporary engagement buckle 81 of the belt temporary fastening member 80.

In the second condition of the belt application process shown in FIG. 9, only the wrap belt 72 is applied to the wheelchair-sitting person P. In this second condition of the belt application process, the webbing 71 (72, 73) is drawn from the retractor 75, and the first engagement fixture 721 of the webbing 71 (72, 73) is connected to the first engagement buckle 76. As a result, the webbing 71 including the wrap belt portion 72 extends around the waist of the wheelchair-sitting person P so as to constrain the waist of the wheelchair-sitting person P. Thus, the wrap belt portion of the seatbelt can be applied to the wheelchair-sitting person P. Further, although hard to see from the drawing, the webbing 71 including the wrap belt portion 72 is passed between the spokes of both wheels of the wheelchair C and passed under both armrests of the wheelchair C, so as to suitably constrain the waist of the wheelchair-sitting person P. At this time, the second engagement fixture 731 attached to the distal end side of the webbing 71 (72, 73) still engages the temporary engagement buckle 81 of the belt temporary fastening member 80.

In the third condition of the belt application process shown in FIG. 10, the second engagement fixture 731 still engaging the temporary engagement buckle 81 of the belt temporary fastening member 80 is temporarily removed therefrom and is connected thereto again, so as to be temporarily connected thereto. The third condition of the belt application process shown in FIG. 10 corresponds to a condition in which only the webbing 71 functioning as the shoulder belt portion 73 is rearranged so as to be drawn upwards in the second condition of the belt application process shown in FIG. 9 in which the belt is passed between the spokes of both wheels of the wheelchair C and passed under both armrests of the wheelchair C. That is, the second engagement fixture 731 engaging the temporary engagement buckle 81 is temporarily disengaged therefrom. Thereafter, only the webbing 71 functioning as the shoulder belt portion 73 is withdrawn from between the spokes of the right side wheel of the wheelchair C. Further, only the webbing 71 functioning as the shoulder belt portion 73 is withdrawn from under the right side armrest of the wheelchair C. Subsequently, the second engagement fixture 731 is connected to the temporary engagement buckle 81 from above the armrest and the wheel again. Thus, a removing operation of the webbing 71 functioning as the shoulder belt portion 73 is performed before the fourth condition of the belt application. Therefore, it is possible to perform the fourth condition of the belt application described below. At this time, the second engagement fixture 731 functioning as the shoulder side support end of the shoulder belt portion 73 engages the temporary engagement buckle 81 of the belt temporary fastening member 80, so as to be temporarily connected thereto. Therefore, the shoulder belt portion 73 can constrain the body of the wheelchair-sitting person P, and can function as a waist seatbelt at the time of the lift-transferring of the platform 21.

In the fourth condition of the belt application shown in FIG. 11, the second engagement fixture 731 engages the second engagement buckle 77 (the final connection support portion) in the vehicle interior M. That is, a connection condition of the second engagement fixture 731 of the shoulder belt portion 73 is changed from a temporary connection in which it is temporarily connected to the temporary engagement buckle 81 of the belt temporary fastening member 80 to a securely supportable connection in which it is securely supported by the second engagement buckle 77 in the vehicle interior M. At this time, as described above, the platform 21 is lift-transferred by the lifting and transferring mechanism 25, so that the platform 21 is positioned in the loading position in the vehicle interior M. Further, although not shown in detail, when the loading assistant (not shown) behind the wheelchair C loaded in the vehicle grasps and pulls the drawing strap portion 85 described above, the temporary engagement buckle 81 is also drawn out backwards. As a result, the second engagement fixture 731 of the shoulder belt portion 73 engaged with the temporary fastening fixture 63 can be also drawn out to move from the temporary connection position to a rearward extracting position. Thus, the second engagement fixture 731 can be moved to the rearward extracting position in which it can be easily grasped by the loading assistant. Therefore, the loading assistant can grasp and hold the second engagement fixture 731, so as to change the connection condition to the securely supportable connection in which it is securely supported by the second engagement buckle 77 in the vehicle interior M. That is, the loading assistant can connect the second engagement fixture 731 of the shoulder belt portion 73 to the second engagement buckle 77 in the vehicle interior M.

The wheelchair seatbelt device 30A of the second embodiment provides the same effect as the wheelchair seatbelt device 30 of the first embodiment described above. In particular, there is a merit that the body of the wheelchair-sitting person P loaded in the vehicle by the wheelchair lifting and transferring device 20 described above can be constrained while the columnar support member used in the conventional platform 21 can be abolished. Further, it is possible to thread the webbing 71 between the spokes of the wheel and to thread the webbing 71 under the armrest of the wheelchair C such that the webbing 71 can reliably contact the body of the wheelchair-sitting person P when the platform 21 is positioned in the getting in/out position in the vehicle exterior N. That is, when the platform 21 is positioned in the loading position in the vehicle interior M, it is possible to apply the shoulder belt portion 73 by performing the simple operation of changing the connection condition of the second engagement fixture 731 to the securely supportable connection to the second engagement buckle 77 disposed in the vehicle interior M.

Further, according to the wheelchair seatbelt device 30A described above, it is possible to change the position of the second engagement fixture 731 from the temporary connection position to the rearward extracting position in which it can be easily grasped. Thus, when the connection condition is changed from the temporary connection in which the second engagement fixture 731 of the shoulder belt portion 73 is temporary connected to the temporary engagement buckle 81 to the securely supportable connection in which it is securely supported by the second engagement buckle 77, the second engagement fixture 731 of the second shoulder belt portion 73 can be easily grasped.

Further, according to the seatbelt device 30A described above, the position of the second engagement fixture 731 can be easily changed to the rearward extracting position in which it can be easily grasped by simply drawing out the drawing strap portion 85. Therefore, it is possible to conveniently perform the belt application operation after the wheelchair C is loaded in the vehicle while reducing bulk and weight thereof.

Further, according to the wheelchair seatbelt device 30A described above, each of the temporary engagement buckle 81 and the second engagement buckle 77 is formed by a buckle formed as a common component to which the second engagement fixture 731 of the shoulder belt portion 73 can be connected. Therefore, there is a merit of using the common component. That is, it is possible to reduce manufacturing costs of the buckles. In addition, it is possible to increase workability of attaching the buckles.

In this first practical example, other various embodiments working are possible.

For example, the rotatable lever of the present invention are not limited to the configuration and the structure in the embodiments described above and may have other appropriate configurations and structures provided that the intermediate portion can be rotatably supported on the handrail attached to the platform.

Similarly, the drawing strap portion of the present invention are not limited to the configuration and the structure of the embodiments described above and may have other appropriate configurations and structures provided that it can be connected to the belt temporary fastening portion so as to drawing out the same.

Each of the temporary fastening fixture 63 and the temporary engagement buckle 81 as the belt temporary fastening portion of the present invention is positioned to be adjacent to the wheelchair C at the time of the lift-transferring. However, the position of the belt temporary fastening portion of the present invention is not limited to such an adjacent position and can be positioned in an appropriate position.

Second Practical Example

Next, a second practical example will be described. In the second practical example, a seatbelt structure added to the wheelchair seatbelt device 30 and 30A of the first practical example described above will be illustrated.

In the following, an embodiment of the present invention will be described with reference to the drawings.

Figure 12:
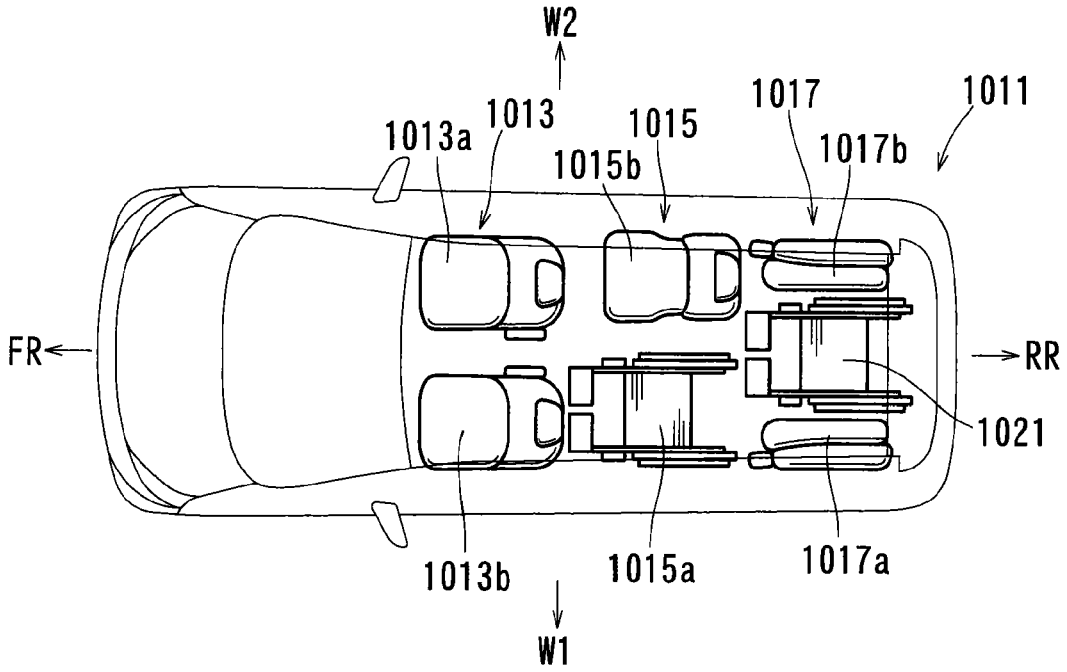
FIG. 12 is an interiorly showing plan view of a vehicle having a seatbelt structure according to a second practical example of the present invention.

FIG. 12 shows a minivan-type vehicle 1011 having a seatbelt structure according to the present embodiment. The vehicle 1011 is constructed such that each of passengers can sit facing in a direction of travel. Arrows FR, RR, UP and LO in the drawing correspond to forward, rearward, upward and downward as seen by the passengers. Further, an arrow W1 indicates one side in a width direction of the vehicle 1011 (a vehicle width direction), and an arrow W2 indicates the other side thereof in the width direction.

Figure 13:
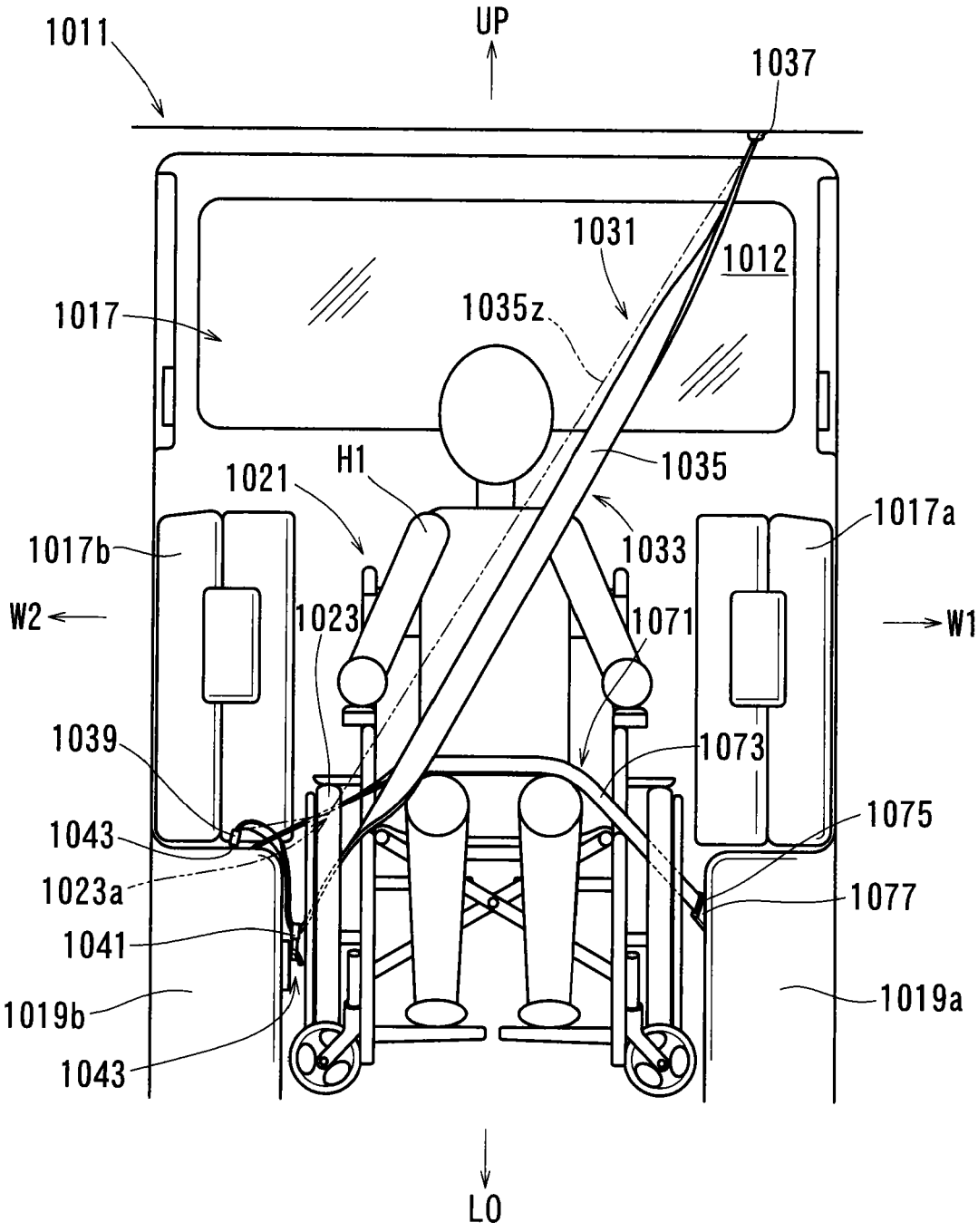
FIG. 13 is a front view illustrating a condition in which a sitting person is constrained by a wheelchair in the embodiment of the present invention.
Figure 14:
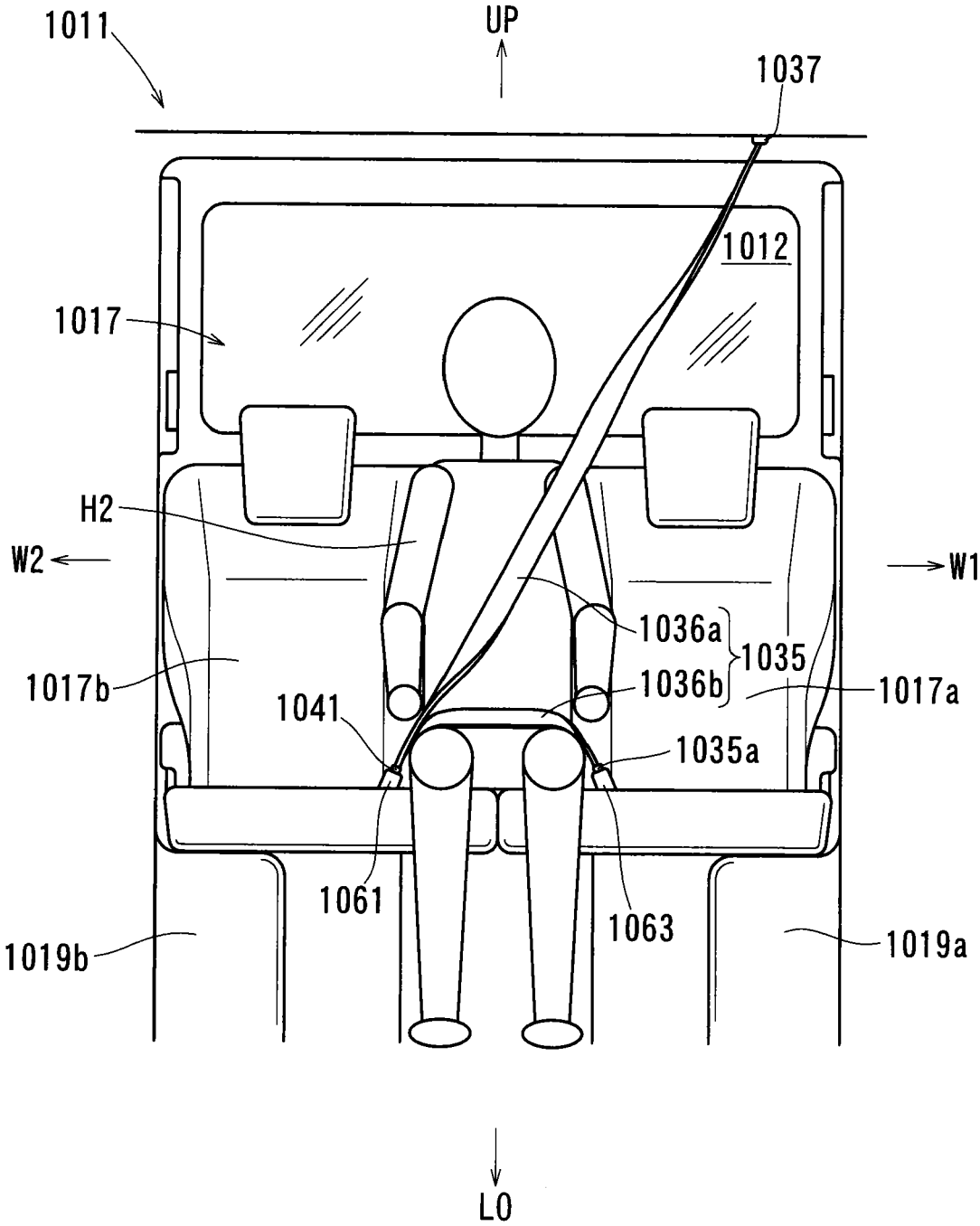
FIG. 14 is a front view illustrating a condition in which a sitting person is constrained in the center of a third seat in the embodiment of the present invention.

As shown in FIG. 12, the vehicle 1011 has three rows of seat positions 1013, 1015 and 1017 that are set in a longitudinal direction. A driver's seat 1013*a* and an assistant driver's seat 1013*b* are disposed in the seat position 1013 in a front row. A space for placing a wheelchair 1015*a* is formed in one side of the seat position 1015 in a second row. A second seat is disposed in the other side of the seat position 1015 in the second row. Disposed in the seat position 1017 in a third row are a pair of third seats 1017*a* and 1017*b* that are capable of being retracted by folding up the same to both sides. FIG. 12 shows a condition in which the third seats 1017*a* and 1017*b* are retracted by folding up the same to both sides. When the third seats 1017*a* and 1017*b* are folded up to one and the other sides, a space can be formed therebetween. The space is capable of place a wheelchair 1021 thereon, so that a person can sit in the wheelchair 1021 thus placed. As shown in FIG. 13, formed in one and the other sides of the seat position 1017 in the third row in a vehicle interior 1012 are swollen portions 1019*a* and 1019*b* forming wheel houses. The swollen portions 1019*a* and 1019*b* are formed by resin molding and are shaped to be swollen from a floor surface and side surfaces. Thus, the third seats 1017*a* and 1017*b* are retracted by folding up the same above the swollen portions 1019*a* and 1019*b*, and the wheelchair 1021 is placed in the space formed between the swollen portions 1019*a* and 1019*b*. As shown in FIG. 14, when the wheelchair 1021 is not loaded, the third seats 1017*a* and 1017*b* are developed to form a continuous seat extending in the vehicle width direction, so that the passengers can sit in one side, the other side and the center thereof in the vehicle width direction.

As shown in FIG. 13, a seatbelt structure 1031 according to the present embodiment is provided in the interior 1012 of the vehicle 1011 in order to constrain a sitting person H1 sitting in the wheelchair 1021 that is placed on the seat position 1017 in the third row. This seatbelt structure 1031 functions to constrain the sitting person H1 while extending obliquely from the shoulder to the chest of the sitting person H1. The vehicle 1011 has a wrap belt structure 1071 laterally wrapping the waist of the sitting person H1 along with this seatbelt structure 1031. In the wrap belt structure 1071, a wrap belt 1073 taken up inside the swollen portion 1019*b* positioned in the other side is drawn out, and a tongue 1075 (FIG. 17) attached to a distal end thereof is then engaged with a fastening member 1077 provided to one side of the seat position 1017, so as to constrain the waist of the sitting person H1. The wrap belt structure 1071 needs not be changed form the conventional wrap belt structure. Thus, this vehicle 1011 is constructed such that the sitting person H1 can be constrained in the wheelchair 1021 by the seatbelt structure 1031 and the wrap belt structure 1071.

Figure 15:
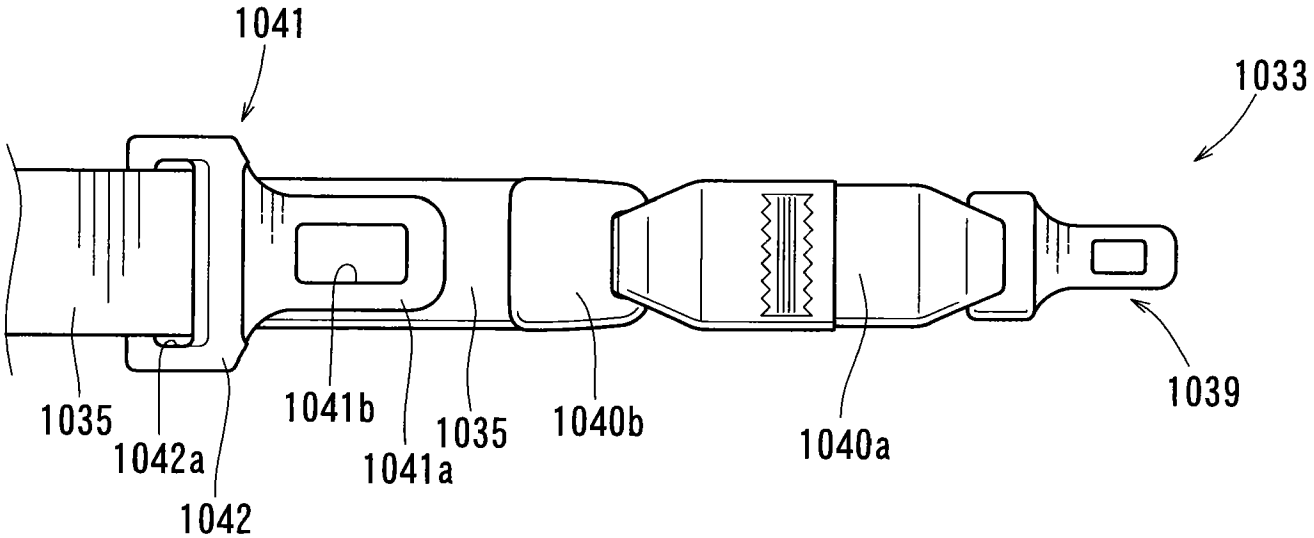
FIG. 15 is an enlarge plan view of a distal end of a belt main body of the embodiment of the present invention.

As shown in FIG. 13, the seat belt structure 1031 has a belt main body 1033 having a belt portion 1035 that extends obliquely from the shoulder on one side of the sitting person H1 to the waist on the other side via the chest, and a take-up device 1037 that is capable of taking up the belt portion 1035. The take-up device 1037 is attached to a ceiling portion of the interior 1012 which portion is positioned above one side of the sitting person H1. This take-up device 1037 needs not be changed from the conventional or known take-up device. As shown in FIG. 15, the belt main body 1033 has a first engagement member 1039 that is attached to a distal end of the belt portion 1035 in a direction in which it is drawn out of the take-up device 1037, and a second engagement member 1041 that is movable in a longitudinal direction of the belt portion 1035.

Figure 16:
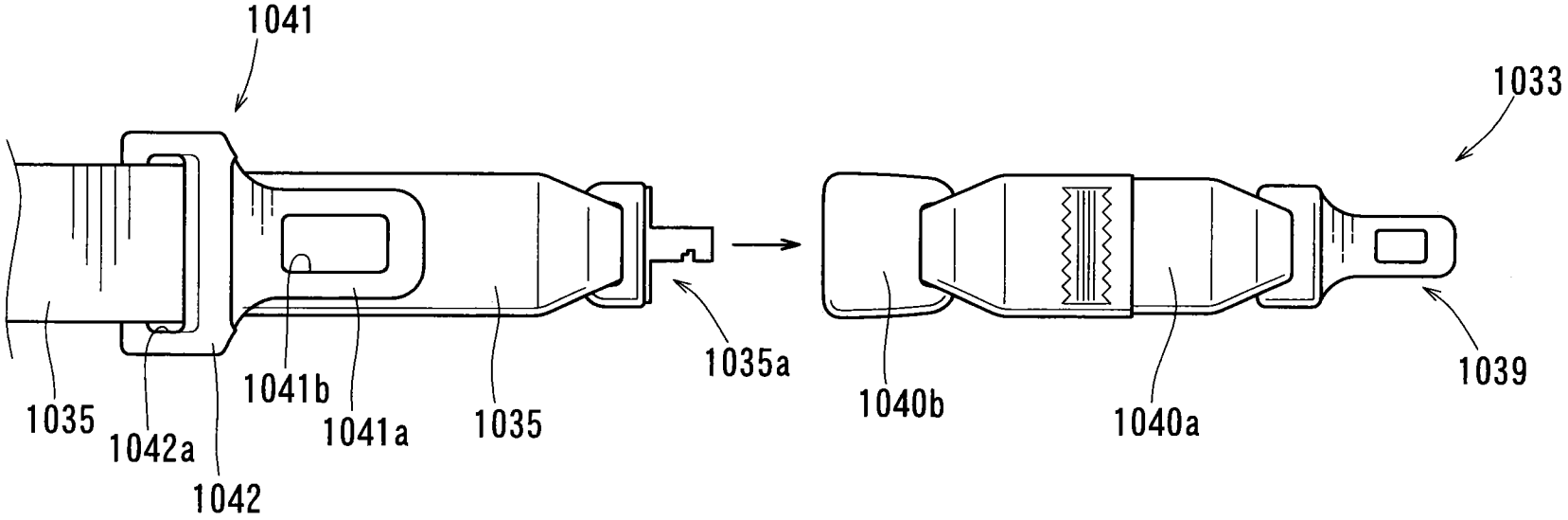
FIG. 16 is an exploded plan view of the belt main body shown in FIG. 15.

As shown in FIG. 16, in the present embodiment, the first engagement member 1039 is capable of detachably engaging a third engagement member 1035*a* that is provided to the distal end of the belt portion 1035. That is, the first engagement member 1039 has a connection member 1040*b* that is connected to a proximal portion thereof via a short belt member 1040*a*, so that the connection member 1040*b* and the third engagement member 1035*a* can be detachably engaged with each other. As shown in FIG. 14, the belt main body 1033 detached from the first engagement member 1039 can be also used to constrain a sitting person H2 sitting in the middle of the third seats 1017*a* and 1017*b*. That is, the second engagement member 1041 is detachably engaged with a fastening member 1061 that is embedded in a seat surface on the other side, and the third engagement member 1035*a* is detachably engaged with a fastening member 1063 that is embedded in a seat surface on one side. Thus, the belt portion 1035 may function as a shoulder belt 1036*a* that extends obliquely from the shoulder portion on one side to the waist on the other side of the sitting person H2 and constrains the chest of the sitting person H2, and may simultaneously be wrapped laterally around the waist to also function as a wrap belt 1036*b*.

The second engagement member 1041 needs not be changed from a tongue used in the conventional seatbelt. That is, as shown in FIG. 16, the second engagement member 1041 is formed by a metal plate, and generally has an engagement portion 1041*a* positioned in a distal end side and a belt attachment portion 1042 positioned in a proximal end side. In the engagement portion 1041*a*, the metal plate is uncovered. The engagement portion 1041*a* has a rectangular engagement hole 1041*b* formed therein, which hole is engageable with a fastening member 1061 (FIG. 14). In the belt attachment portion 1042, the metal plate is covered with resin. The belt attachment portion 1042 has a slot 1042*a* formed therein, which slot allows the belt portion 1035 to be passed therethrough. When the belt portion 1035 is passed through this slot 1042*a* with play, the second engagement member 1041 can be attached to the belt main body 1033.

Figure 17:
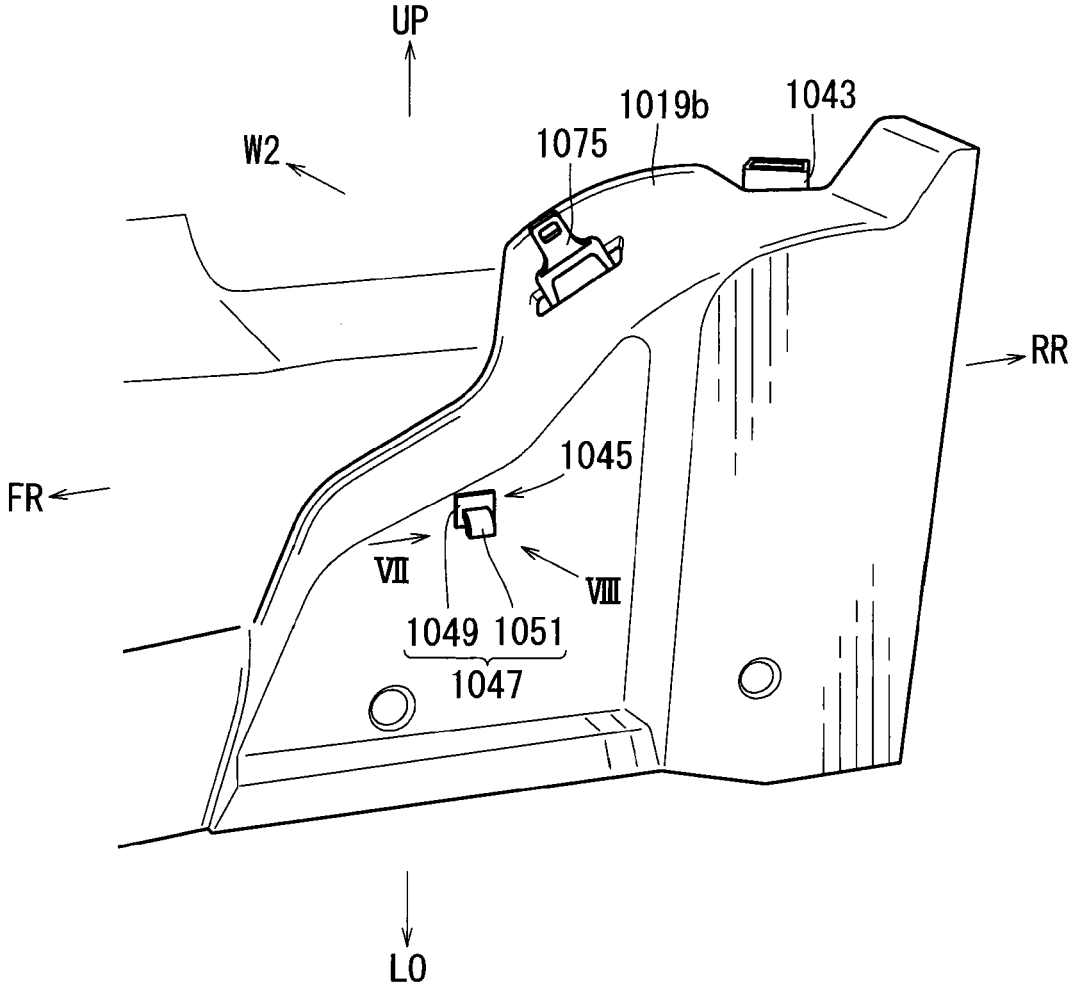
FIG. 17 is a perspective view of an engaged means of the embodiment of the present invention.

The description will return to the seatbelt structure 1031 in which the first engagement member 1039 is attached to the distal end of the belt portion 1035 in order to constrain the sitting person H1 sitting in the wheelchair 1021. As shown in FIG. 17, on the other side, the seatbelt structure 1031 has a buckle 1043 to which the first engagement member 1039 is detachably connected, and has an engaged means 1045 to which the second engagement member 1041 is hooked.

An engagement structure of the first engagement member 1039 and the buckle 1043 is not particularly limited. That is, it is possible to use an engagement structure in which the tongue of the conventional seatbelt is used as the first engagement member 1039 and in which the tongue of the conventionally known seatbelt is inserted into and engaged with the buckle. The buckle 1043 is integrally attached to an upper portion of the swollen portion 1019*b* positioned in the other side.

Figure 18:
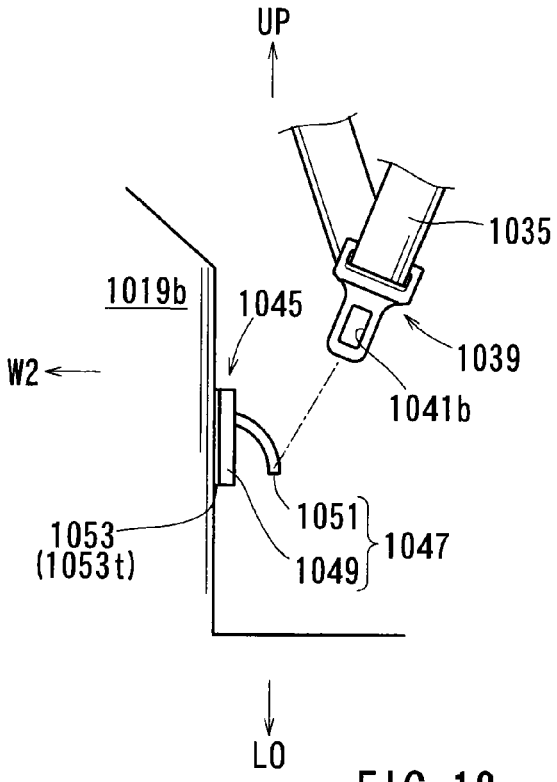
FIG. 18 is a view of the engaged means shown in FIG. 17, which view is viewed from arrow VII.

The engaged means 1045 to which the second engagement member 1041 is hooked is attached to a side portion of the swollen portion 1019*b* positioned in the other side so as to be positioned lower than the buckle 1043 to which the first engagement member 1039 is connected. As shown in FIG. 18, the engaged means 1045 has a hook member 1047, and a bonding unit 1053 for bonding the hook member 1047 to the swollen portion 1019*b* positioned in the other side. The hook member 1047 has a plate-shaped base portion 1049 extending along a side surface of the swollen portion 1019*b*, and a hook portion 1051. The hook portion 1051 is protruded from the base portion 1049 and curved downwards and is shaped such that the engagement hole 1041*b* of the second engagement member 1041 can be hooked thereon. The bonding unit 1053 includes an adhesive tape 1053*t*. That is, in the engaged means 1045, the base portion 1049 is bonded to the side surface of the swollen portion 1019*b* via the adhesive tape 1053*t* at a back surface thereof opposite to a front surface thereof having the hook portion 1051.

Figure 20:
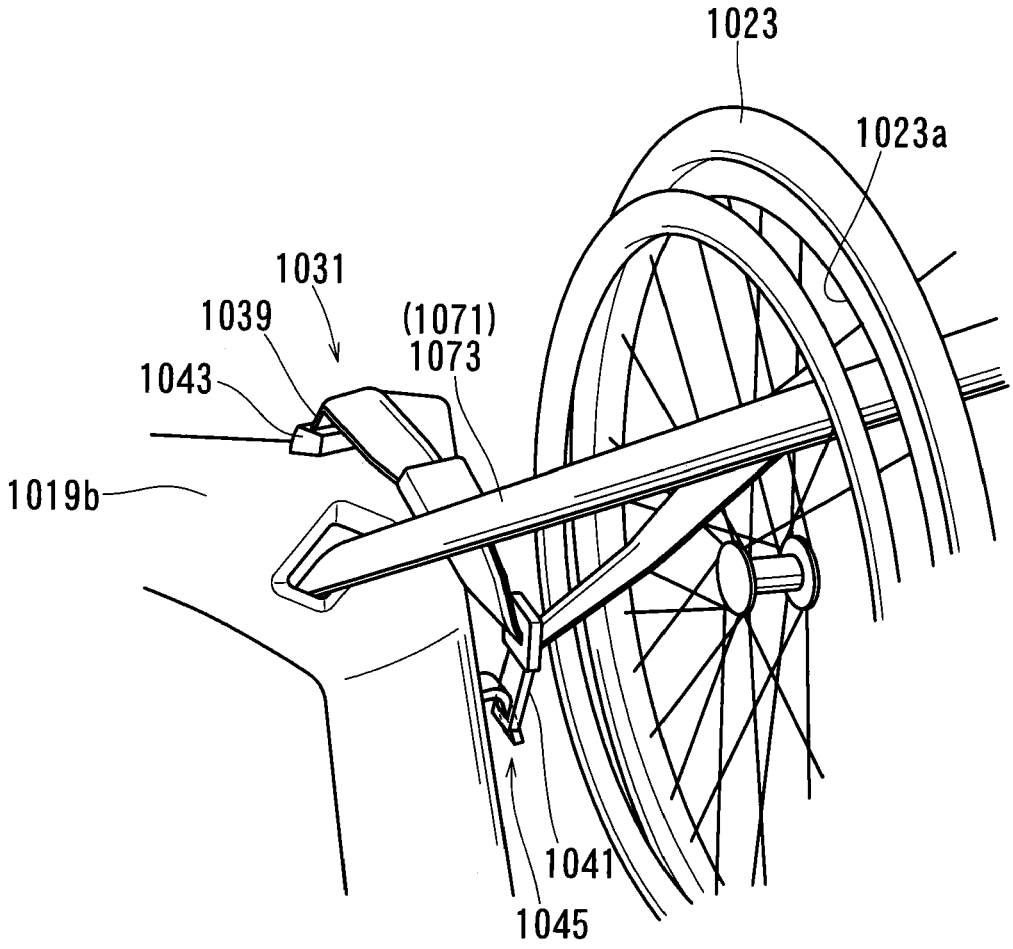
FIG. 20 is an enlarged perspective view, which shows a positional relation between a belt portion and a wheel of the wheelchair in a condition in which a second engagement member locked to the engaged means in the embodiment of the present invention.

A height position of the engaged means 1045 is determined to a lowered position such that when the second engagement member 1041 is hooked thereon, the belt portion 1035 can be positioned spaced away from the neck of the sitting person H1 compared to when the first engagement member 1039 is directly connected to the buckle 1043 while the second engagement member 1041 is hooked thereon. To explain this height position of the engaged means 1045, a description will be first given of an application route of the belt portion 1035 to the sitting person H1 when the first engagement member 1039 is connected to the buckle 1043 while the second engagement member 1041 is not hooked on the engaged means 1045. As shown in FIG. 13, the belt portion 1035 is drawn from the take-up device 1037, and is threaded through a wheel 1023 positioned in the other side of the wheelchair 1021. In this condition, the first engagement member 1039 attached to the distal end of the belt portion 1035 is connected to the buckle 1043. In the present embodiment, when the first engagement member 1039 is directly engaged with the buckle 1043 while the second engagement member 1041 is not hooked on the engaged means 1045, as shown by chain double-dashed line 1035*z* in FIG. 13, an inner edge 1023*a* (FIG. 20) of the wheel 1023 of the wheelchair 1021 interferes with a middle portion of the belt portion 1035, so that the application route of the belt portion 1035 to the sitting person H1 substantially corresponds to a straight line connecting the take-up device 1037 and the inner edge 1023*a* of the wheel 1023. At this time, the belt portion 1035 extends obliquely passing through a position in close proximity to the neck of the sitting person H1. Next, a description will be given of an application route of the belt portion 1035 to the sitting person H1 when the second engagement member 1041 is hooked on the engaged means 1045. As shown in FIG. 20, when the second engagement member 1041 is hooked on the engaged means 1045, the belt portion 1035 is separated from the inner edge 1023*a* of the wheel 1023, and as indicated by solid line in FIG. 13, the application route of the belt portion 1035 to the sitting person H1 substantially corresponds to a straight line connecting the take-up device 1037 and the engaged means 1045. The belt portion 1035 extends obliquely while being spaced away from the neck of the sitting person H1. Thus, the engaged means 1045 is positioned in a lower position, so that when the second engagement member 1041 is hooked thereon, the application route thereof can be changed in a direction in which the belt portion 1035 is spaced away from the neck of the sitting person H1.

Figure 19:
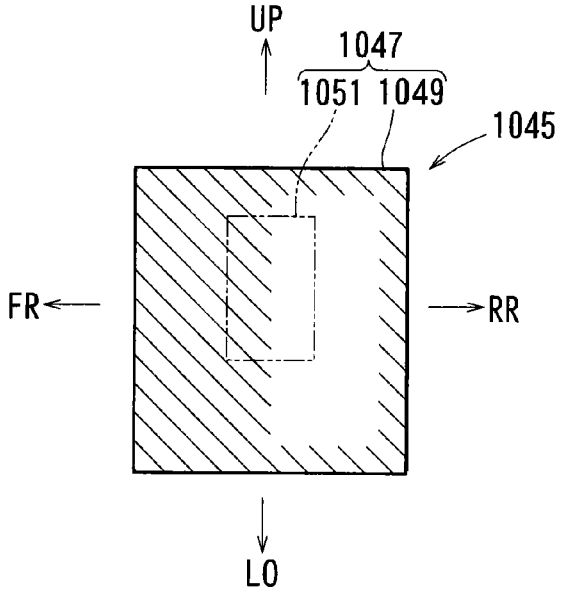
FIG. 19 is a view of the engaged means shown in FIG. 17, which view is viewed from arrow VIII.

When the second engagement member 1041 attached to the belt portion 1035 that is drawn out against a taking-up action force of the belt portion 1035 in the take-up device 1037 is hooked on the hook portion 1051, an upward force is exerted on the engaged means 1045 due to the take-up action force described above, so that the second engagement member 1041 can be securely hooked on the hook portion 1051. The engaged means 1045 has a fragile structure which can withstand the upward action force in an engagement condition at the time of this normal application of belt and which can be broken by a forward load exerted thereto at the time of collision of the vehicle 1011. In the present embodiment, the engaged means 1045 can be broken by loss of bonding to the swollen portion 1019*b* by the adhesive tape 1053*t*. The base portion 1049 of the hook member 1047 has a rectangular shape. Further, as indicated by hatched line in FIG. 19, the adhesive tape 1053*t* is applied to the entire area in a front side portion of the base portion 1049 and applied to only in a periphery in a rear side portion thereof. Thus, adhesion strength in the rear portion is lower as compared with that in the front portion, so that the entire hook member 1047 can be relatively easily separated from the swollen portion 1019*b* when a forward load not less than a desired level is applied to the hook portion 1051. At the time of collision of the vehicle 1011, taking-up action of the belt portion 1035 by the take-up device 1037 is locked due to the forward load generated in the sitting person H1. As a result, the forward load can be transmitted to the engaged means 1045 via the belt portion 1035, so that the hook member 1047 can be separated from the swollen portion 1019*b*. As a result, the engagement condition of the second engagement member 1041 to the engaged means 1045 is released. Similar to the conventional seatbelt, engagement strength of the first engagement member 1039 to the buckle 1043 is high enough to withstand the forward load generated in the sitting person H1 at the time of collision of the vehicle, so that an engagement condition therebetween can be maintained. Thus, in the seatbelt structure 1031, at the time of collision of the vehicle 1011, the belt portion 1035 can constrain the sitting person H1 while the first engagement member 1039 is directly engaged with the buckle 1043.

The seatbelt structure 1031 constructed as described above provides the following effects.

At the time of the normal application of belt, the second engagement member 1041 is hooked on the engaged means 1045, so that the belt portion 1035 can be positioned to be relatively spaced away from the neck of the sitting person H1. Therefore, it is possible to secure comfort. Conversely, at the time of collision of the vehicle, the engagement condition of the second engagement member 1041 that is capable of maintaining the belt portion 1035 in a position spaced away from the neck of the sitting person H1 is released, so that the belt portion can be positioned in the position relatively close to the neck in which it can exert constraint performance. Accordingly, it is possible to secure the comfort at the time of normal application of belt and to secure the constraint performance for constraining the sitting person at the time of collision of the vehicle. In order to obtain this effect, the engaged means 1045 is additionally positioned in the interior 1012 of the vehicle 1011 while the hook member 1047 thereof is bonded to the swollen portion 1019*b*, and there is no need for a change in the basic structure of the interior 1012 of the vehicle 1011. Further, the engagement condition of the second engagement member 1041 can be released by separation of the hook member 1047 from the swollen portion 1019*b*, so that the swollen portion 1019*b* can be prevented from being broken.

Further, when the second engagement member 1041 used to constrain the sitting person H2 sitting in the middle of the third seats 1017*a* and 1017*b* constrains the sitting person H1 of the wheelchair 1021, it is hooked on the engaged means 1045, so that there is involved no surplus engagement members. Thus, there is no fear of the surplus engagement members contacting the wheelchair 1021 or other such members to generate noise.

In this second practical example, various forms are possible.

For example, the bonding unit 1053 of the engaged means 1045 is not limited to the adhesive tape 1053*t*, and it is possible to use various bonding means as the bonding unit 1053. For example, it is possible to use a hook-and-loop fastener as the bonding unit 1053. A bonded condition may be maintained when the hook-and-loop fastener is closed, and the engaged means 1045 can be broken when the hook-and-loop fastener is opened. The fragile structure of the engaged means 1045 broken by the forward load exerted at the time of collision of the vehicle 1011 can be provided to the hook member 1047. That is, the hook member 1047 can be constructed such that the engagement condition of the second engagement member 1041 can be released by breakage of the hook member 1047.

The embodiment can be expressed as follows.

A vehicle seatbelt structure capable of constraining a sitting person sitting in the wheelchair placed in the vehicle interior, which includes a belt main body having a belt portion capable of being drawn from a take-up device that is positioned in the interior, a first engagement member that is provided to a distal end of the belt portion, and a second engagement member that is movable in a longitudinal direction of the belt portion, the take-up device being positioned on one side of the sitting person sitting in the wheelchair and above the shoulder of the sitting person in a sitting posture, wherein a buckle capable of being detachably engaged with the first engagement member is disposed on the other side of the sitting person in the interior such that the belt portion drawn from the take-up device can be positioned in close proximity to the neck of the sitting person in a condition in which the belt portion is directly applied to extend obliquely from the shoulder to the chest of the sitting person, wherein an engaged means capable of being engaged with the second engagement member is disposed on the other side of the sitting person in a position lower than a height position of the buckle, the lower position in which the engaged means is disposed being set such that the belt portion can be positioned spaced away from the neck in a condition in which the belt portion is applied to extend obliquely from the shoulder to the chest of the sitting person sitting in the wheelchair when the second engagement member is engaged with the engaged means, and wherein at the time of collision of the vehicle, the engaged means can be broken by a forward load generated in the sitting person sitting in the wheelchair to release an engagement condition of the second engagement member to the engaged means, whereas an engagement condition of the first engagement member to the buckle can be maintained.

In the present embodiment, "positioned in close proximity to the neck" and "positioned spaced away from the neck" imply two positions of the belt portion that have two different distances relative to the neck of the person. The description "positioned in close proximity to the neck" means that the belt portion is positioned relatively close to the neck. Conversely, the description "positioned spaced away from the neck" means that the belt portion is positioned relatively spaced away from the neck.

According to the seatbelt structure, the engaged means is set such that the second engagement member can be engaged therewith. Therefore, the belt portion can be positioned to be spaced away from the neck of the person during normal application of belt. This may secure comfort to the person during normal application of belt. Further, at the time of collision of the vehicle, the engagement condition of the second engagement member to the engaged means can be released, so that the first engagement member can be directly engaged with the buckle. As a result, the belt portion is positioned in close proximity to the neck. This may secure constraint performance to the person at the time of collision of the vehicle.

The vehicle seatbelt structure can be constructed such that the belt main body can be used as a shoulder belt and a wrap belt for constraining a person sitting in a seat that is arranged when the wheelchair is not loaded in a loading position in which the wheelchair can be disposed. Therefore, with regard to the person sitting in each of the seat and the wheelchair that can be positioned in the same horizontal position in the vehicle interior, this structure can compatibly secure constraint performance to the person at the time of collision of the vehicle and comfort to the person during normal application of belt.

According to the present embodiment, it is possible to compatibly attain securing of constraint performance to constrain the person sitting in the wheelchair at the time of collision of the vehicle and securing comfort to the person during normal application of belt without considerably changing in structure.

Further, when the belt main body is used as a shoulder belt and a wrap belt for constraining a person sitting in a seat that is arranged when the wheelchair is not loaded in a loading position in which the wheelchair can be disposed, with regard to the person sitting in each of the seat and the wheelchair, it is possible to compatibly secure constraint performance to the person at the time of collision of the vehicle and comfort to the person during normal application of belt.

Third Practical Example

Next, a third practical example will be described. In the third practical example, a lifting device, which is provided as the lifting and transferring mechanism 25 of the wheelchair seatbelt device 30 and 30A in the first practical example described above, will be described.

Figure 21:
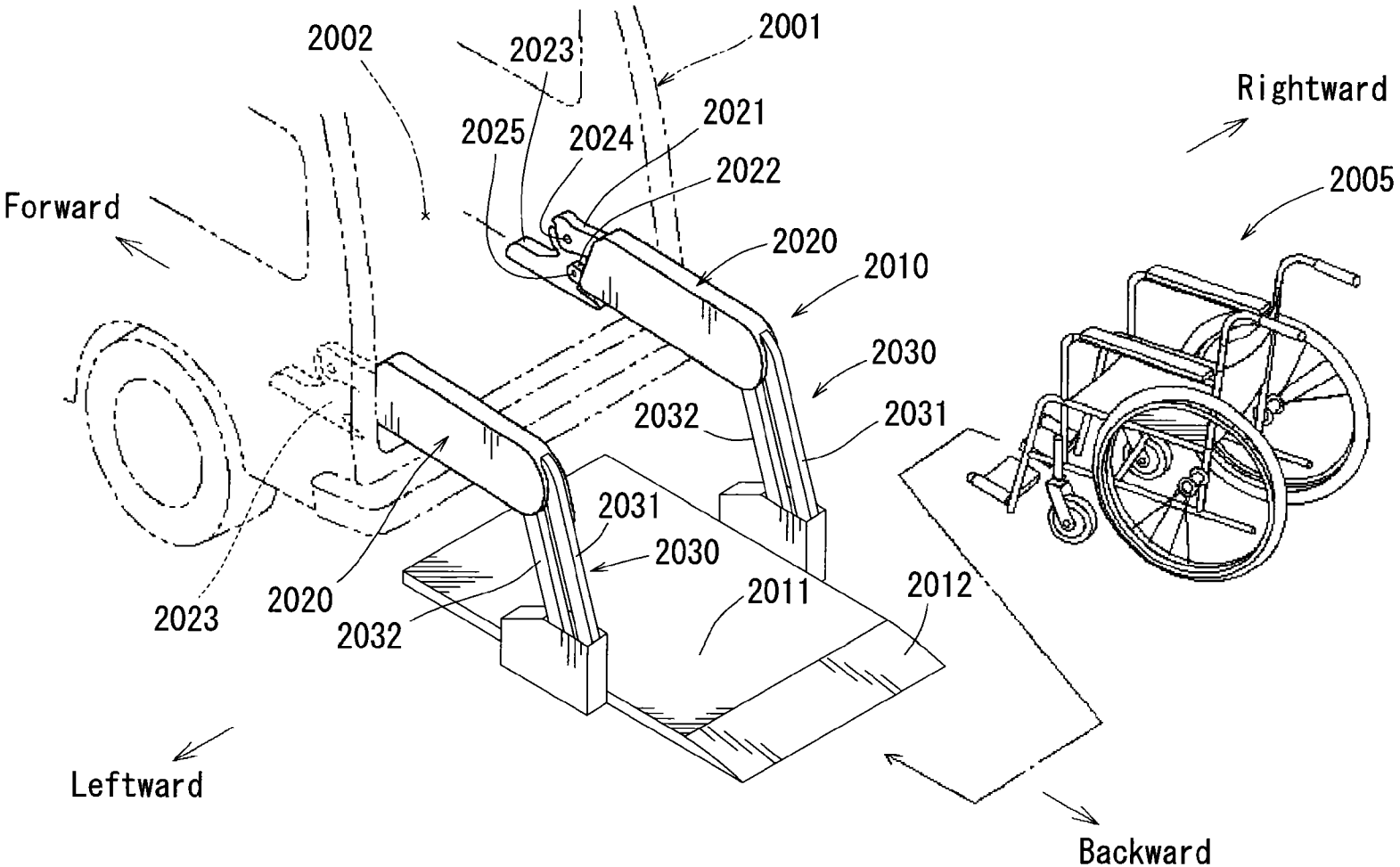
FIG. 21 is a perspective view of a lifting device according to a first embodiment of a third practical example.

Next, embodiments of the present invention will be described with reference to FIGS. 21 to 26. FIG. 21 shows a vehicle 2001 having the lifting device 2010 of a first embodiment. This vehicle 2001 is a welfare vehicle of a so-called minivan-type vehicle having an opening 2002 (a door opening) formed in a rear portion thereof. This rear opening 2002 is opened and closed by a flap-type back door. The lifting device 2010 of the present embodiment described below is disposed in this rear opening 2002. By utilizing this lifting device 2010, a wheelchair 2005 in which a person is sitting can be easily loaded from a road surface in a vehicle exterior into a vehicle interior and vice versa.

Figure 22:
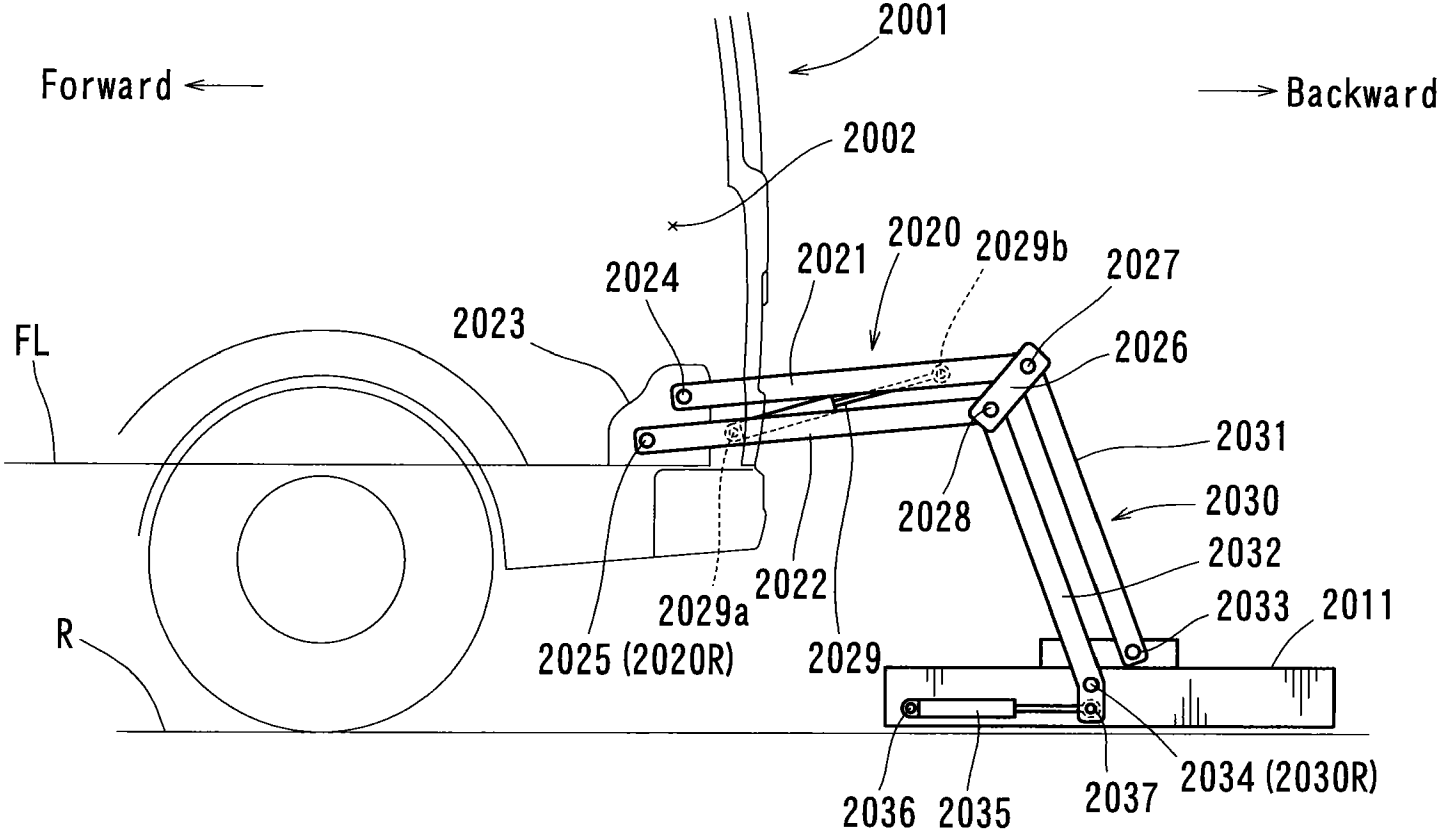
FIG. 22 is a simplified side view of the lifting device of the first embodiment.

This lifting device 2010 has a platform 2011 having an area that is capable of receiving the wheelchair 2005 in which the person is sitting, a pair of right and left first rotating members 2020 and 2020 and a pair of right and left second rotating members 2030 and 2030 that are configured to move the platform 2011 between a retracting position positioned along a vehicle floor FL and a projecting position positioned on the road surface R in a vehicle exterior. In the present embodiment, a four-joint link mechanism is used in each of the first rotating members 2020 and 2020 and the second rotating members 2030 and 2030. Since the first and second rotating members 2020 and 2030 are respectively symmetrically provided in right-and-left pairs, the following description will be centered on one side. FIG. 22 shows the first and second rotating members 2020 and 2030 on one side.

Figure 23:
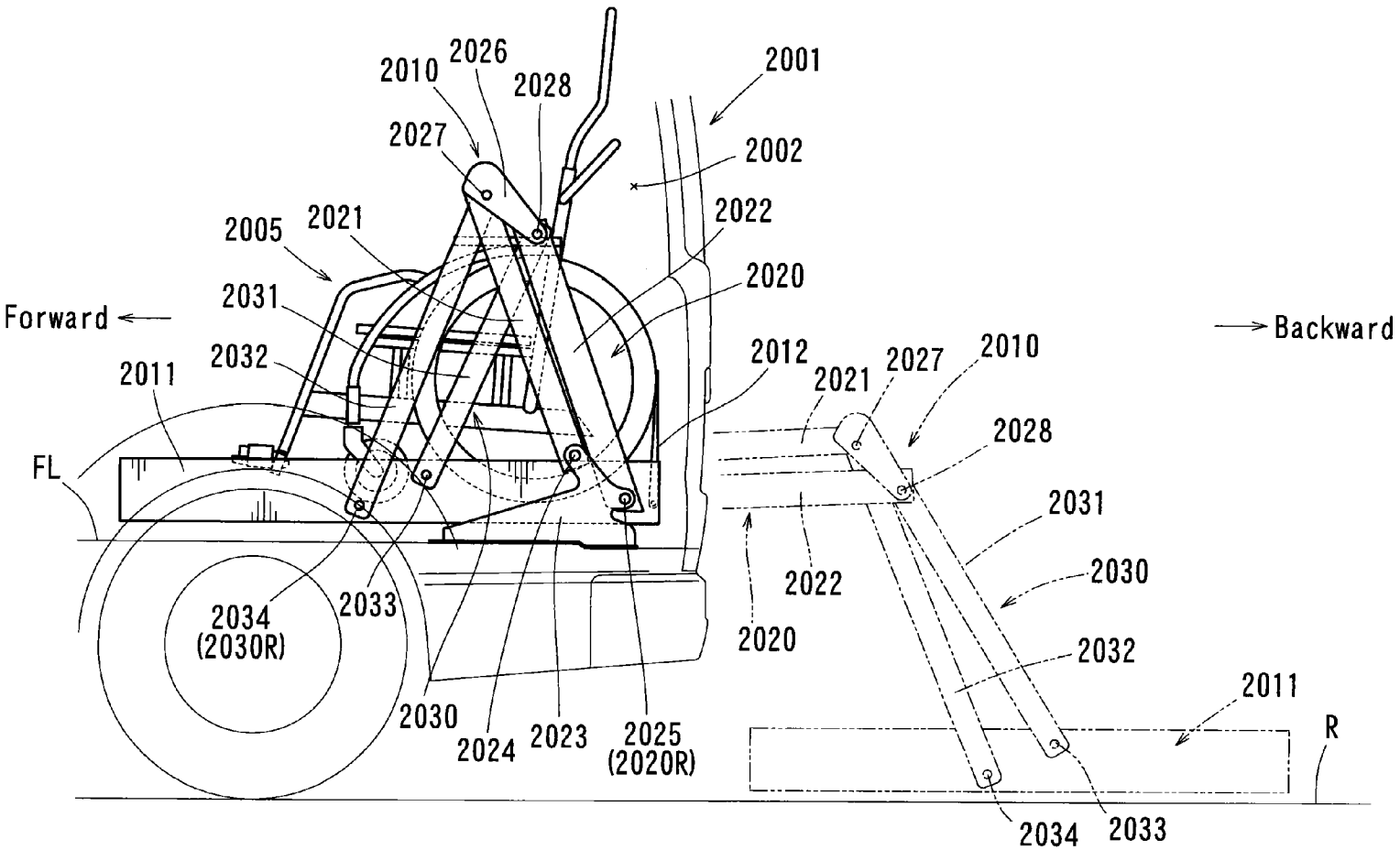
FIG. 23 is a side view of the lifting device of the first embodiment. In this view, the lifting device positioned in a retracting position is indicated by a solid line, and the lifting device positioned in an extracting position is indicated by a chain double-dashed line.
Figure 24:
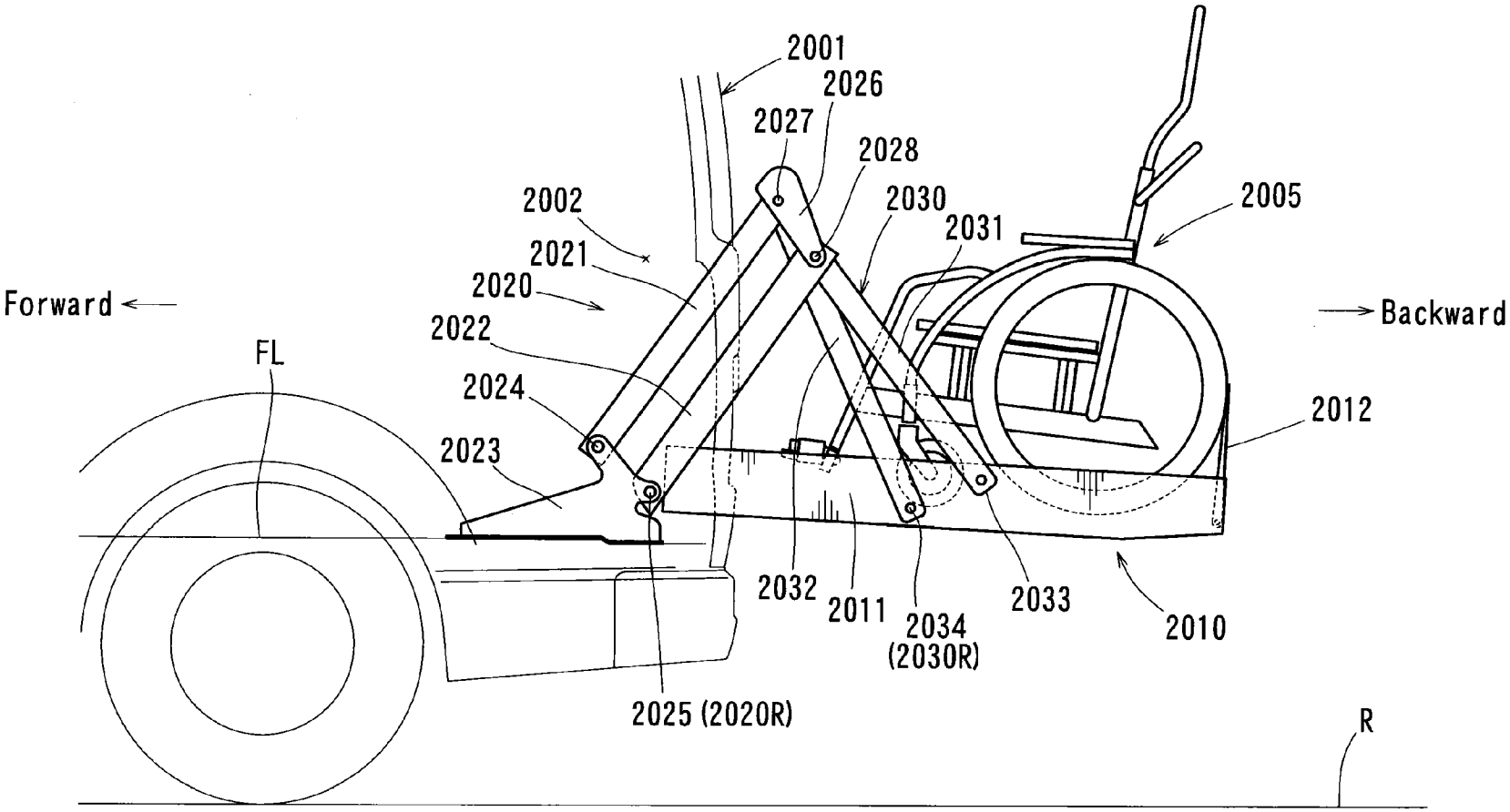
FIG. 24 is a side view of the lifting device of the first embodiment. This view show a step in which a platform is moving in a middle position between the retracting position and the extracting position.
Figure 25:
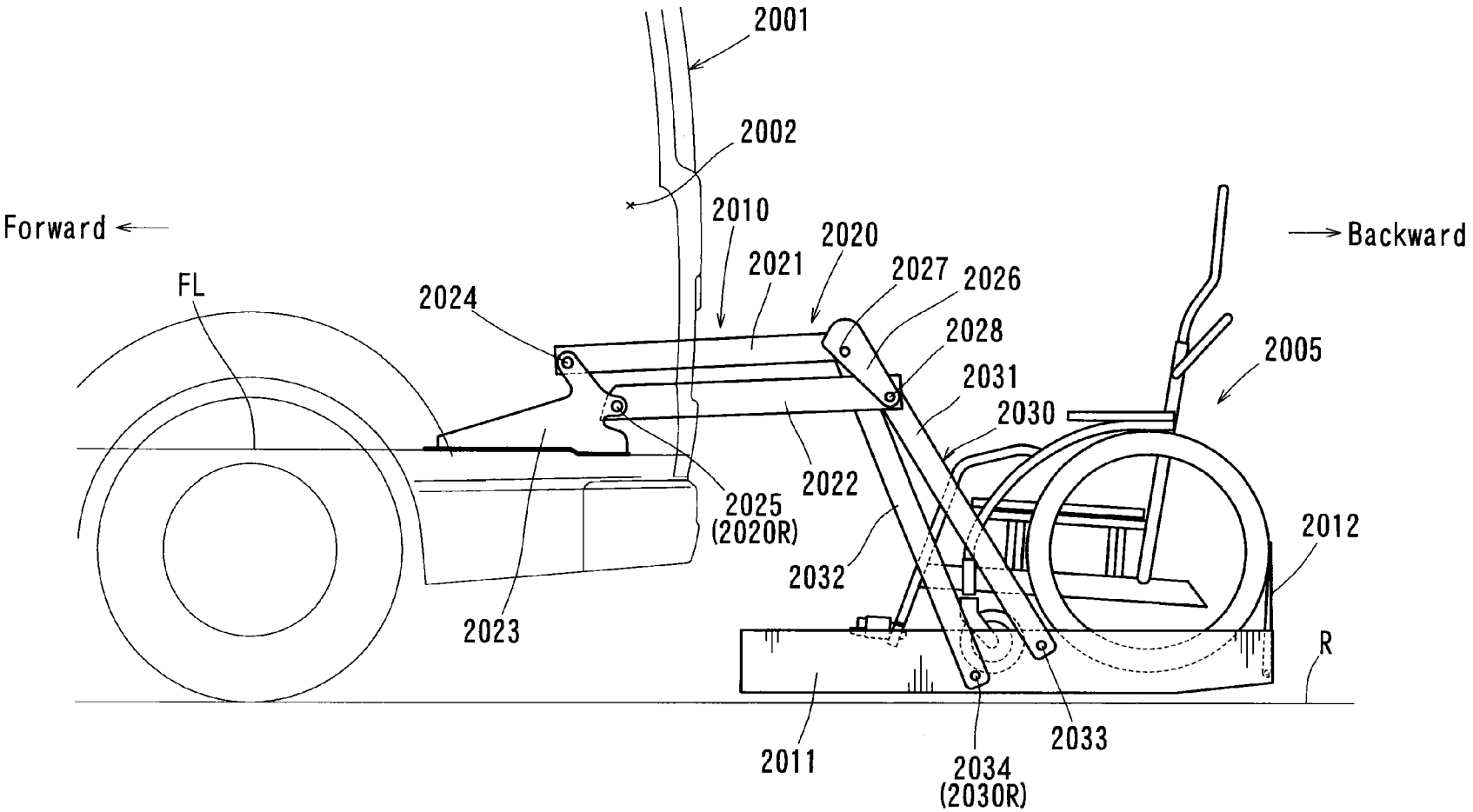
FIG. 25 is a side view of the lifting device of to the first embodiment. This view shows a condition in which the platform is extracted to the extracting position.

A slope plate 2012 is provided to a rear end portion of the platform 2011. As shown in FIG. 21, when this slope plate 2012 is set to a rearwardly projected posture, it is possible to easily perform movement between the platform 2011 and the road surface R. As shown in FIGS. 23 to 25, this slope plate 2012 can be locked in a raised posture. When the slope plate 2012 is raised, the slope plate 2012 can function as a rear side stopper, so that the placed wheelchair 2005 placed on the platform 2011 can be prevented from coming off therefrom.

Further, although not shown, this platform 2011 has a hook, a belt or other such devices for fastening the wheelchair 2005 placed thereon. By using these fastening means, it is possible to prevent inadvertent positional deviation, inclination and others of the wheelchair 2005 when the wheelchair 2005 is being moved between the vehicle interior and the road surface and when the vehicle is traveling. Thus, the sitting person can remain sitting in the wheelchair at ease.

A remote control for remote controlling the lifting device 2010 is disposed in the vicinity of the rear opening 2002. Further, an operation tower is provided to a side portion of the platform 2011. The same remote control is provided to the upper portion of the operation tower. When the sitting person of the wheelchair 2005 or an assistant operates a getting-in button or a getting-out button of one of the remote controls, the lifting device 2010 can e actuated.

The first rotating member 2020 has two link arms 2021 and 2022. Rotation proximal ends of the two link arms 2021 and 2022 are respectively vertically rotatably supported on a floor bracket 2023 attached to the vehicle floor FL via support shafts 2024 and 2025. Rotation distal ends of the two link arms 2021 and 2022 are respectively rotatably connected to a connection plate 2026 via support shafts 2027 and 2028. A four-joint parallel link mechanism is formed by the two link arms 2021 and 2022, the floor bracket 2023 and the connection plate 2026. Connection points of the four-joint parallel link mechanism thus formed correspond to the support shafts 2024, 2025, 2027 and 2028.

A first drive source 2029 as a drive source of the first rotating member 2020 is disposed between the two link arms 2021 and 2022. In the present embodiment, a hydraulic cylinder is used as the first drive source 2029. A head side of the first drive source 2029 is vertically rotatably supported on the link arm 2022 via a support shaft 2029*a*, and a distal end side of a rod is vertically rotatably connected to the link arm 2021 via a support shaft 2029*b*. When the first drive source 2029 is actuated by a pressurized oil supplied from a hydraulic source (not shown), the first rotating member 2020 can rotate vertically within a predetermined angular range. Timing of actuation and deactuation of the first drive source 2029 can be controlled by a hydraulic control circuit including the hydraulic source described above. Further, a variable flow rate valve can be controlled by the hydraulic control circuit, so that an operation speed of the first drive source 2029 can be appropriately controlled.

The second rotating member 2030 has two link arms 2031 and 2032. Rotation proximal ends of the two link arms 2031 and 2032 are respectively vertically rotatably supported via the support shafts 2027 and 2028 of the connection plate 2026. Rotation distal ends of the two link arms 2031 and 2032 are respectively vertically rotatably connected to a side portion of the platform 2011 via support shafts 2033 and 2034. In the second rotating member 2030, a four-joint parallel link mechanism is formed by the two link arms 2031 and 2032, the connection plate 2026 and the platform 2011. Connection points of the four-joint parallel link mechanism correspond to the support shafts 2027, 2028, 2033 and 2034.

A second drive source 2035 as a drive source of the second rotating member 2030 is disposed between the link arm 2032 and the platform 2011. A hydraulic cylinder is also used as the second drive source 2035. A head side of the second drive source 2035 is vertically rotatably supported on a side portion of the platform 2011 via a support shaft 2036, and a distal end side of a rod is vertically rotatably connected to the link arm 2032 via a support shaft 2037. A telescopic motion of the second drive source 2035 can be controlled independently of the first drive source 2029 described above. Due to the telescopic motion of the second drive source 2035, a rotating position of the platform 2011 with respect to the link arm 2032 can be controlled, so that a rotating position (posture) of the platform 2011 with respect to the second rotating member 2030 can be controlled. When the posture of the platform 2011 with respect to the second rotating member 2030 is controlled by the second drive source 2035, a vertical rotating position of the second rotating member 2030 with respect to the first rotating member 2020 can be controlled.

Similar to the first drive source 2029, timing of actuation and deactuation of the second drive source 2035 and an operation speed of the second drive source 2035 and others can be controlled by a hydraulic control circuit including a variable flow rate valve. In FIG. 21 and FIGS. 23 to 25, the first and second drive sources 2029 and 2035 are not shown.

Further, a first angle detector (encoder) 2020R for detecting a rotating position (rotating angle) of the link arm 2022 is incorporated into the support shaft 2025 of the first rotating member 2020. This first angle detector 2020R is capable of accurately detecting the rotating angle of the rotating member 2020 with respect to an initial position (retracting position) thereof. Further, a second angle detector (encoder) 2030R for detecting a rotating position (rotating angle) of the link arm 2032 is incorporated into the support shaft 2034 of the second rotating member 2030. This second angle detector 2030R is capable of accurately detecting the rotating position (rotating angle) of the platform 2011 with respect to the second rotating member 2030. As a result, the rotating angle of the second rotating member 2030 with respect to the first rotating member 2020 can be indirectly detected. Based on the rotating angles of the first and second rotating members 2020 and 2030 and the rotating position of the platform 2011 detected by the first and second angle detectors 2020R and 2030R, the actuation and deactuation of the first and second drive source 2029 and 2035 and the operating speeds thereof and others can be controlled.

FIG. 23 shows the lifting device 2010 positioned in a retracted condition. In this retracted condition, the platform 2011 is loaded along the vehicle floor FL. The wheelchair 2005 in which the person sits can be secured on the platform 2011. The platform 2011 includes fixing members and others for securing the wheelchair 2005, which members are positioned thereon. In this retracted condition, the first rotating member 2020 is refracted in a position in which both link arms 2021 and 2022 thereof are inclined obliquely forwards and upwards from the floor bracket 203. The second rotating member 2030 is refracted in a condition in which it is inclined obliquely forwards and downward from a rotation distal end side of the first rotating member 2020. In this retracted condition, the rear opening 2002 can be closed by the back door.

When the getting-out switch of the remote control (not shown) is turned on in this retracted condition, the lifting device 2010 moves toward a getting-out side. When the lifting device 2010 moves toward the getting-out side, the first drive source 2029 first actuated toward the getting-out side, so that the first rotating member 2020 can be rotated rearwards (toward the getting-out side). When the first rotating member 2020 starts to rotate rearwards, the rotation distal end side (upper portion) thereof is displaced along an upwardly convex arcuate path, so that the platform 2011 can be displaced rearwards (toward the rear opening) from the vehicle floor FL while being displaced upwardly.

After the first rotating member 2020 has started to rotate toward the getting-out side, the second rotating member 2030 starts toward the getting-out side after the elapse of a slight amount of time. When the second rotating member 2030 moves toward the getting-out side, a rotation distal end portion (lower portion) thereof is displaced along a downwardly convex arcuate path, so that an upward displacing motion of the platform 2011 caused by the rotation of the first rotating member 2020 can be compensated for. As a result, the platform 2011 can be translated backwards while maintaining a substantially horizontal posture after it is separated from the vehicle floor 2011.

Thus, the platform 2011 can be translated backwards while maintaining the horizontal posture as when it is positioned in the vehicle interior. Therefore, the person sitting in the wheelchair 2005 experiences no uneasiness.

As shown in FIG. 23, the second rotating member 2030 positioned before the first rotating member 2020 can rotate backwards at a higher speed. As a result, as shown in FIG. 24, the second rotating member 2030 can rotate backwards passing through a lateral side of the first rotating member 2020, so that the platform 2011 can be translated backwards while maintaining the horizontal posture without substantially involving any vertical displacement. Thus, the platform 2011 may be provided with the same sliding motion as the conventional slide mechanism.

As shown in FIG. 24, after the second rotating member 2030 is greatly rotated toward rearwards, and the platform 2011 is horizontally moved to the vehicle exterior, an actuation speed of the first drive source 2029 is increased, so that the platform 2011 can be lowered from a height position of the vehicle floor to the projecting position in which it substantially contacts the road surface R. During that time, the platform 2011 is maintained in an ascent/descent posture in which it is slightly inclined such that a rear side thereof is lower than a front side thereof. Due to this ascent/descent posture, the wheelchair 2005 can be restricted from moving backwards by the slope plate 2012. Therefore, due to this ascent/descent posture, the wheelchair 2005 can be maintained in place on the platform 2011 only by the rear side stopper (the slope plate 2012) without providing a front side stopper to the platform 2011.

After the platform 2011 has been lowered to contact the road surface R, the slope plate 2012 is downwardly rotated to contact the road surface R. Thereafter, the fixing members of the wheelchair 2005 are released. Thus, the sitting person of the wheelchair 2005 can move from the platform 2011 onto the road surface R while sitting in the wheelchair 2005.

To the contrary, when the person gets in the vehicle 2001 while sitting in the wheelchair 2005, the wheelchair 2005 is moved from the road surface R onto the platform 2011, and the wheelchair 2005 is secured in place by the fixing members. Thereafter, the slope plate 2012 is locked in the raised posture. Subsequently, the getting-in button of the remote control is turned on to move the lifting device 2010 toward a getting-in side. A motion of the lifting device 2010 toward the getting-in side is reverse to the motion thereof toward the getting-out side (FIG. 25→FIG. 24→FIG. 23).

When the lifting device 2010 moves toward the getting-in side, the first drive source 2029 is actuated, so that the first rotating member 2020 can be rotated upwardly (toward the getting-in side). As a result, the platform 2011 ascends along an arcuate path. Similar to a getting-out time, during an ascent motion, the platform 2011 is maintained in the ascent/descent posture in which it is slightly inclined such that the rear side thereof is lower than the front side thereof. During that time, the slope plate 2012 locked in the raised posture can function as the rear side stopper.

As shown in FIG. 24, when the platform 2011 ascends to the height position of the vehicle floor, the second drive source 2035 is actuated, so that the second rotating member 2030 can rotate toward the vehicle interior passing through the lateral side of the first rotating member 2020. During that time, the first rotating member 2020 also rotates forwards by the first drive source 2029, so that the platform 2011 can be maintained in the horizontal posture. Thus, the first and second rotating members 2020 and 2030 rotate forwards at respective speeds, so that the platform 2011 can be transferred to the retracting position on the vehicle floor FL while the horizontal posture thereof is maintained. When the platform 2011 has reached the retracting position, loading of the wheelchair 2005 and the sitting person can be completed.

According to the lifting device 2010 of the present embodiment thus constructed, the platform 2011 can be moved between the retracting position positioned on the vehicle floor FL and the projecting position positioned on the road surface R by the first rotating member 2020 vertically rotatably supported on the vehicle floor FL and the second rotating member 2030 vertically rotatably connected to the first rotating member 2020. Therefore, it is possible to move the platform 2011 similar to the conventional slide mechanism without using such a mechanism. Thus, it is possible to reduce the number of components as compared with the conventional lifting device, thereby reducing weight and cost.

Further, in the conventional device, an ascent/descent motion by the link mechanism and a sliding motion by the slide mechanism can be performed independently in terms of time. Therefore, when operational switching between the ascent/descent motion and the sliding motion is performed, shock generated by switching of the related drive source can be transmitted to the platform. However, in the lifting device 2010 of the present embodiment, the first drive source 2029 and the second drive source 2035 can be simultaneously actuated in order to move the platform between the retracting position and the projecting position. As a result, the ascent/descent motion and the horizontal displacing motion of the platform 2011 can be performed as a smoothly continuous motion, so that the platform can be effectively prevented from being subjected to shock compared to the conventional device. Therefore, the person sitting in the wheelchair 2005 can get a sense of ease. Further, the lifting device 2010 can be improved in terms of usability.

The first embodiment described above can be variously modified. For example, in the embodiment, the first drive source 2029 is attached between the link arms 2021 and 2022 via the support shafts 2029*a* and 2029*b*, the first drive source 2029 can be attached between the two link arms 2021 and 2022 via the support shafts 2025 and 2027 or the support shafts 2024 and 2028.

Further, in the embodiment, the second drive source 2035 is provided between the link arm 2032 and the platform 2011. However, the second drive source 2035 can be provided between the two link arms 2031 and 2032 of the second rotating member 2030.

Further, in the embodiment, the four-joint parallel link mechanism is used as each of the first rotating member 2020 and the second rotating member 2030. However, it is possible to use a four-joint link mechanism in which the rotation distal end side of each of the first rotating member 2020 and the second rotating member 2030 is not displaced in parallel. In such a case, the platform can be translated while maintaining the horizontal posture thereof by appropriately controlling the first and second drive sources. Further, each of the first and second rotating members can be formed by a link mechanisms having five or more joints.

Figure 26:
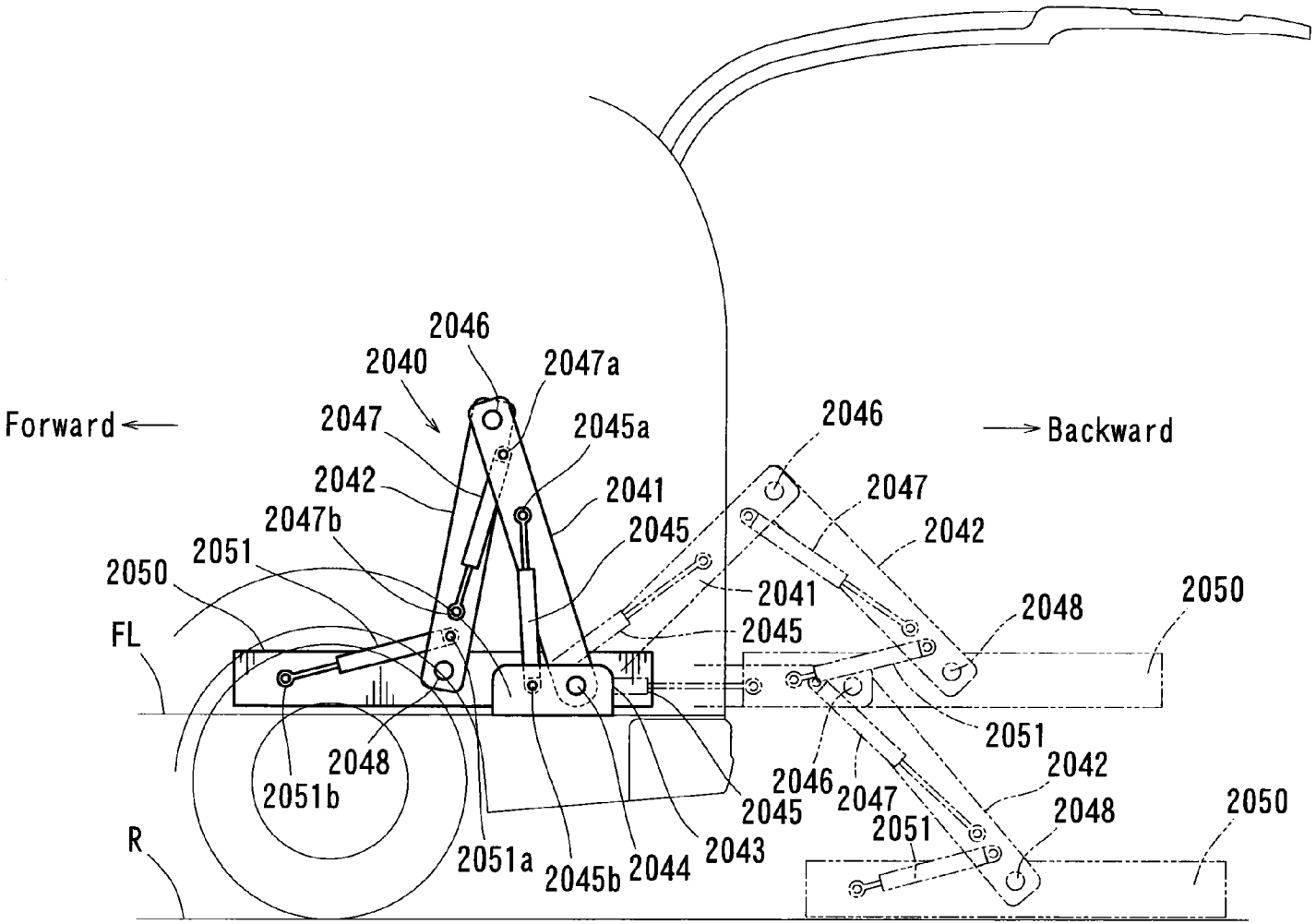
FIG. 26 is a simplified side view of a lifting device according to a second embodiment. In this view, the lifting device positioned in a retracting position is indicated by a solid line, and the lifting device positioned in a middle position and an extracting position is indicated by a chain double-dashed line.

Further, FIG. 26 shows a lifting device 2040 of a second embodiment. In the lifting device 2010 of the first embodiment described above, the link mechanisms are used as the first and second rotating members 2020 and 2030. However, in this second embodiment, each of first and second rotating members 2041 and 2042 is formed by a single rotating arm and not by the link mechanism.

The first rotating member 2041 is supported on the vehicle floor FL via a floor bracket 2043. This first rotating member 2041 is vertically rotatably supported via a support shaft 2044. A first drive source 2045 is provided between the first rotating member 2041 and the floor bracket 2043. A head side of the first drive source 2045 is rotatably supported on the floor bracket 2043 via a support shaft 2045*a*. A rod side of the first drive source 2045 is rotatably connected to the first rotating member 2041 via a support shaft 2045*b*.

A second rotating member 2042 is relatively rotatably connected to a rotation distal end side of the first rotating member 2041 via a support shaft 2046. The second rotating member 2042 is capable of relatively rotating by a second rive source 2047 provided between the second rotating member 2042 and the first rotating member 2041. A head side of the second drive source 2047 is rotatably supported on the first rotating member 2041 via a support shaft 2047*a*. A rod distal end side of the second drive source 2047 is rotatably connected to the second rotating member 2042 via a support shaft 2047*b*.

A rotation distal end side of the second rotating member 2042 is rotatably connected to a side portion of a platform 2050 via a support shaft 2048. A third drive source 2051 is provided between the second rotating member 2042 and the platform 2050. A head side of the third drive source 2051 is rotatably supported on the second rotating member 2042 via a support shaft 2051*a*. A rod distal end side of the third drive source 2051 is rotatably connected to the side portion of the platform 2050 via a support shaft 2051*b*. A hydraulic cylinder is used as each of the first to third drive sources 2045, 2047 and 2051.

The first to third drive sources 2045, 2047 and 2051 are respectively controlled based on a rotation angle of the first rotating member 2041 with respect to the vehicle floor FL which angle is detected by a first angle detector, a rotation angle of the second rotating member 2042 with respect to the first rotating member 2041 which angle is detected by a second angle detector, and a rotation angle of the platform 2050 with respect to the second rotating member 2042 which angle is detected by a third angle detector. Therefore, a horizontal posture of the platform 2040 can be constantly maintained, and a position thereof can be detected.

According to the lifting device 2040 of the second embodiment thus constructed, rotating motions of the first rotating member 2041 and the second rotating member 2042 can be combined with each other, so that the platform 2050 can be moved by a large distance in a longitudinal direction of the vehicle between the retracting position positioned along the vehicle floor FL and the projecting position positioned along the road surface R. As a result, it is possible to omit the conventional slide mechanism to reduce the number of components, thereby reducing weight and cost of the lifting device 2040. In particular, in the lifting device 2040 of the second embodiment, each of the first rotating member 2041 and the second rotating member 2042 is formed by the single rotating arm and not the link mechanism used in the first embodiment. Therefore, the number of components can be further reduced.

The embodiment can be expressed as follows.

A lifting device that is configured to move the platform on which the wheelchair is placed between a retracting position positioned along a vehicle floor and a projecting position positioned along a road surface in a vehicle exterior, which includes a first rotating member vertically rotatably supported on the vehicle floor, a first drive source configured to vertically rotate the first rotating member, a second rotating member vertically rotatably supported on a rotation distal end side of the first rotating member; and a second drive source configured to vertically rotate the second rotating member with respect to the first rotating member, wherein the platform is rotatably supported on a rotation distal end side of the second rotating member, and wherein rotating motions of the two rotating members are combined with each other to move the platform between the retracting position and the projecting position while changing a relative angle of the platform with respect to the second rotating member.

According to this lifting device, the platform is supported on the vehicle floor via the first rotating member and the second rotating member. Therefore, the vertical rotating motions of the two rotating members are combined with each other, so that the platform can be moved between the retracting position along the vehicle floor and the projecting position in the vehicle exterior. Because the rotating motions of the first and second rotating members are combined, a sufficient horizontal moving amount of the large platform can be obtained, so that the platform can be moved between the retracting position in a vehicle interior and the projecting position in the vehicle exterior while the conventional slide mechanism is omitted. Further, the platform can be translated in a horizontal direction by appropriately controlling moving amounts, operational timing and others of the first and second rotating members.

In this specification, the term "horizontal" used to describe a posture or a moving direction of the platform may covers not only a precisely horizontal posture and a precisely horizontal direction but also a posture or a direction that is slightly inclined with respect to the horizontal direction to a degree in which the person sitting in the wheelchair experience no uneasiness.

Further, in this lifting device, the rotating motions of the first and second rotating members are combined with each other, so that the platform can be moved. Therefore, it is possible to eliminate a possible shock that can be generated by operational switching between the conventional link mechanism and the conventional slide mechanism.

Further, in the lifting device, a four-joint link mechanism may be used as the second rotating member. The second drive source may be provided between the second rotating member and the platform to control the rotating motion of the platform with respect to the second rotating member, so that the rotating motion of the second rotating member with respect to the first rotating member can be controlled.

According to this lifting device, because the second rotating member is the four-joint link mechanism, a rotating position of the second rotating member with respect to the first rotating member can be indirectly controlled by controlling a motion of the second drive source provided between the second rotating member and the platform. Thus, the second drive source that is capable of controlling rotational motions of the second rotating member and the platform can be positioned, for example, along a lower surface side of the platform and not in the link mechanism of the second rotating member. Therefore, it is possible to simplify a structure of a portion around the second rotating member.

Further, in the lifting device, a cylinder may be used as the second drive source. A head side of the cylinder may be rotatably supported on a side portion of the platform via a support shaft and a rod side of the cylinder is rotatably supported on the second rotating member via a support shaft. Due to a telescopic operation of the second drive source, a rotating angle of the platform with respect to the second rotating member can be changed.

According to this lifting device, when the cylinder as the second drive source is telescopically operated, the rotation angle of the platform with respect to the second rotating member can vary, so that the platform can be maintained in a horizontal posture or an ascent/descent posture in which it is slightly inclined.

Further, in the lifting device, a four-joint link mechanism may be used as each of the first rotating member and the second rotating member. A distance between two connection points on the rotation distal end side of the first rotating member is fixed, and the two connection points are constructed to function as two connection points on the rotation proximal end side of the second rotating member.

According to this lifting device, the rotation distal end side of the first rotating member formed by the four-joint link mechanism and the rotation proximal end side of the second rotating member formed by the four-joint link mechanism are connected to each other via common connection points. Therefore, it is possible to easily perform a posture control of the platform.

Further, in the lifting device, at least two of a rotation angle $\theta 1$ of the first rotating member with respect to the vehicle floor, a rotation angle $\theta 2$ of the second rotating member with respect to the first rotating member and a rotation angle $\theta 3$ of the platform with respect to the second rotating member may be detected. Motions of the first and second drive sources can be controlled based on the detected rotation angles.

According to this lifting device, it is possible to reliably control the horizontal posture or the ascent/descent posture of the platform. In addition, it is possible to easily correct the posture of the platform.

The invention claimed is:

1. A wheelchair seatbelt device provided to a wheelchair lifting and transferring device having a platform on which a wheelchair is placed and a lifting and transferring mechanism that is configured to lift-transfer the platform from a getting in/out position in a vehicle exterior to a loading position in a vehicle interior, the device being configured to constrain a body of a wheelchair-sitting person sitting in the wheelchair in a placed condition in which the wheelchair is placed on the platform, the wheelchair seatbelt device, comprising:

a wrap belt portion capable of constraining a waist of the wheelchair-sitting person, and a shoulder belt portion having one end that constitutes a waist side support end corresponding to a waist side of the wheelchair-sitting person and the other end that constitutes a shoulder side support end corresponding to a shoulder side of the wheelchair-sitting person, and capable of being extended obliquely from a shoulder to the waist of the wheelchair-sitting person to constrain an upper half of the body of the wheelchair-sitting person, wherein the waist side support end of the shoulder belt portion is supported by a platform side support portion disposed on the platform, wherein the shoulder side support end of the shoulder belt portion is capable of being connected to both of a belt temporary fastening portion disposed on the platform and a final connection support portion disposed in the vehicle interior, and is capable of being temporarily connected to the belt temporary fastening portion when the platform is positioned in the getting in/out position and when the platform is lift-transferred, and wherein when the platform is positioned in the loading position, a connection condition of the shoulder side support end of the shoulder belt portion can be changed from a temporary connection in which it is temporarily connected to the belt temporary fastening portion to a securely supportable connection in which it is connected to the final connection support portion in the vehicle interior.

2. The wheelchair seatbelt device according to claim 1, wherein the shoulder belt portion has an engagement fixture that is engageable with a buckle, and wherein each of the belt temporary fastening portion of the platform and the final connection support portion positioned in the vehicle interior is formed by the buckle formed as a common component to which the engagement fixture is connected.

3. The wheelchair seatbelt device according to claim 1, wherein in order to change the connection condition of the shoulder side support end of the shoulder belt portion from the temporary connection of the belt temporary fastening portion to the securely supportable connection of the final connection support portion, the belt temporary fastening portion is provided with a moving means that is configured to move the shoulder side support end of the shoulder belt portion temporarily connected to the belt temporary fastening portion to an extracting position that is positioned above or behind a temporarily connected position.

4. The wheelchair seatbelt device according to claim 3, wherein the moving means is a rotatable lever of which an intermediate portion is rotatably supported on a handrail provided to the platform, and wherein an operating portion for rotationally operating the rotatable lever is provided to a proximal end side of the rotatable lever, the belt temporary fastening portion being provided to a distal end side of the rotatable lever.

5. The wheelchair seatbelt device according to claim 1, wherein the platform side support portion is positioned adjacent to the wheelchair placed on the platform in a width direction of the wheelchair, and wherein the belt temporary fastening portion to which the shoulder side support end of the shoulder belt portion is temporarily connected is positioned in a side opposite to the platform side support portion such that the wheelchair placed on the platform can be positioned therebetween.

6. A vehicle seatbelt structure added to the wheelchair seatbelt device according to claim 1, the vehicle seatbelt structure capable of constraining a sitting person sitting in the wheelchair placed in the vehicle interior, the vehicle seatbelt structure comprising a belt main body having a belt portion capable of being drawn from a take-up device that is positioned in the interior, a first engagement member that is provided to a distal end of the belt portion, and a second engagement member that is movable in a longitudinal direction of the belt portion, the take-up device being positioned on one side of the sitting person sitting in the wheelchair and above the shoulder of the sitting person in a sitting posture, wherein a buckle capable of being detachably engaged with the first engagement member is disposed on the other side of the sitting person in the interior such that the belt portion drawn from the take-up device can be positioned in close proximity to a neck of the sitting person in a condition in which the belt portion is directly applied to extend obliquely from the shoulder to a chest of the sitting person, wherein an engaged means capable of being engaged with the second engagement member is disposed on the other side of the sitting person in a position lower than a height position of the buckle, the lower position in which the engaged means is disposed being set such that the belt portion can be positioned spaced away from the neck in a condition in which the belt portion is applied to extend obliquely from the shoulder to the chest of the sitting person sitting in the wheelchair when the second engagement member is engaged with the engaged means, and wherein, at the time of collision of the vehicle, the engaged means can be broken by a forward load generated in the sitting person sitting in the wheelchair to release an engagement condition of the second engagement member to the engaged means, whereas an engagement condition of the first engagement member to the buckle can be maintained.

7. The vehicle seatbelt structure according to claim 6, wherein the belt main body can be used as a shoulder belt and a wrap belt for constraining a person sitting in a seat that is arranged when the wheelchair is not loaded in a loading position in which the wheelchair can be disposed.

8. A lifting device provided as the lifting and transferring mechanism of the wheelchair seatbelt device according to claim 1, the lifting device being configured to move the platform on which the wheelchair is placed between a retracting position positioned along a vehicle floor and a projecting position positioned along a road surface in a vehicle exterior, the lifting device comprising a first rotating member vertically rotatably supported on the vehicle floor, a first drive source configured to vertically rotate the first rotating member, a second rotating member vertically rotatably supported on a rotation distal end side of the first rotating member; and a second drive source configured to vertically rotate the second rotating member with respect to the first rotating member, wherein the platform is rotatably supported on a rotation distal end side of the second rotating member, and wherein rotating motions of the two rotating members are combined with each other to move the platform between the retracting position and the projecting position while changing a relative angle of the platform with respect to the second rotating member.

9. The lifting device according to claim 8, wherein a four-joint link mechanism is used as the second rotating member, and wherein the second drive source is provided between the second rotating member and the platform to control the rotating motion of the platform with respect to the second rotating member, so that the rotating motion of the second rotating member with respect to the first rotating member can be controlled.

10. The lifting device according to claim 9, wherein a cylinder is used as the second drive source, wherein a head side of the cylinder is rotatably supported on a side portion of the platform via a support shaft and a rod side of the cylinder is rotatably supported on the second rotating member via a support shaft, and wherein due to a telescopic operation of the second drive source, a rotating angle of the platform with respect to the second rotating member can be changed.

11. The lifting device according to claim 8, wherein a four-joint link mechanism is used as each of the first rotating member and the second rotating member, wherein a distance between two connection points on the rotation distal end side of the first rotating member is fixed, and wherein the two connection points are constructed to function as two connection points on the rotation proximal end side of the second rotating member.

12. The lifting device according to claim 8, wherein at least two of a rotation angle 1 of the first rotating member with respect to the vehicle floor, a rotation angle 2 of the second rotating member with respect to the first rotating member and a rotation angle 3 of the platform with respect to the second rotating member are detected, and wherein motions of the first and second drive sources are controlled based on the detected rotation angles.

* * * * *